US008939846B2

(12) United States Patent
Hudach

(10) Patent No.: US 8,939,846 B2
(45) Date of Patent: Jan. 27, 2015

(54) SELF-CONTAINED, RESETTABLE BOWLING PIN RELEASE

(71) Applicant: David Hudach, Streetsboro, OH (US)

(72) Inventor: David Hudach, Streetsboro, OH (US)

( * ) Notice: Subject to any disclaimer, the term of this patent is extended or adjusted under 35 U.S.C. 154(b) by 0 days.

(21) Appl. No.: 14/090,310

(22) Filed: Nov. 26, 2013

(65) Prior Publication Data

US 2014/0155185 A1 Jun. 5, 2014

Related U.S. Application Data

(60) Provisional application No. 61/731,660, filed on Nov. 30, 2012.

(51) Int. Cl.
*A63D 5/08* (2006.01)

(52) U.S. Cl.
CPC ..... *A63D 5/08* (2013.01)
USPC ..... 473/73; 473/84

(58) Field of Classification Search
CPC ..... A63D 5/08
See application file for complete search history.

(56) References Cited

U.S. PATENT DOCUMENTS

| | | | | | |
|---|---|---|---|---|---|
| 996,250 | A | * | 6/1911 | Hughes | 473/83 |
| 1,584,030 | A | * | 5/1926 | Gray | 473/83 |
| 2,231,473 | A | * | 2/1941 | Kaufman | 473/83 |
| 2,550,919 | A | * | 5/1951 | Frye | 473/83 |
| 2,621,961 | A | * | 12/1952 | Horn et al. | 294/115 |
| 2,709,083 | A | * | 5/1955 | Huck | 473/83 |
| 2,879,997 | A | * | 3/1959 | Black et al. | 473/88 |
| 2,977,121 | A | * | 3/1961 | Thomas et al. | 473/89 |
| 3,386,734 | A | * | 6/1968 | Congelli et al. | 473/73 |
| 5,393,269 | A | * | 2/1995 | Atkinson, Jr. | 473/73 |

* cited by examiner

*Primary Examiner* — William Pierce
(74) *Attorney, Agent, or Firm* — Fay Sharpe LLP

(57) ABSTRACT

A bowling pin release mechanism, which is used to release bowling pins onto the lane for the first ball, which is pin cell independent. As such, aside from the vertical, reciprocating motion of the frame structure on which it is mounted, does not require additional mechanical or electromechanical mechanisms or components for pin release and reset operations. The resettable pin support and release mechanisms are contained within the pin cell.

2 Claims, 49 Drawing Sheets

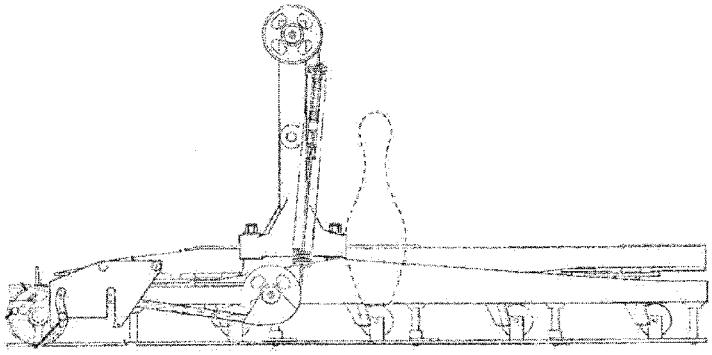
Fig. 1a
PRIOR ART
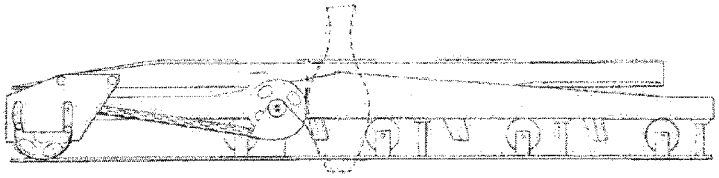
Fig. 1b
PRIOR ART
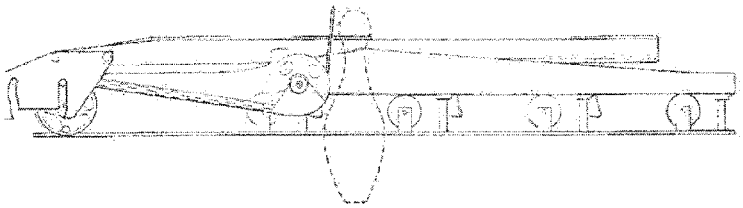
Fig. 1c
PRIOR ART
Fig. 1d.
PRIOR ART
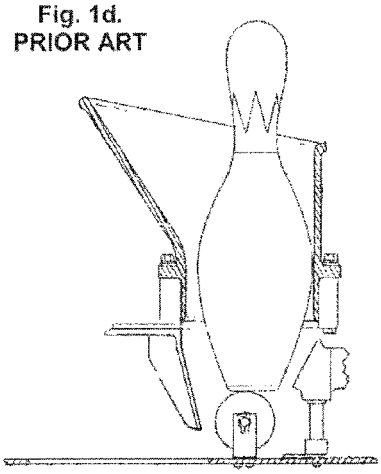
Fig. 1e
PRIOR ART
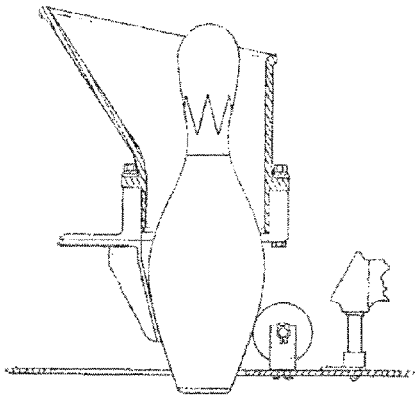

SELF-CONTAINED, RESETTABLE BOWLING PIN RELEASE

REFERENCE TO RELATED APPLICATIONS

This application claims one or more inventions which were disclosed in Provisional Application No. 61/731,660, filed Nov. 30, 2013, entitled "Self-Contained, Resettable Bowling Pin Release". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of bowling pinsetter or pinspotter machines. More particularly, the invention pertains to apparatus and mechanisms in said machines that release bowling pins from their support structures or holders during the operation that sets bowling pins onto the bowling lane playing surface in preparation for the first ball of a frame in the game of bowling.

2. Description of Related Art

In the game of bowling, it is necessary to set or place the required number of bowling pins onto the bowling game playing surface in preparation for the first ball of a frame. When this act of setting the bowling pins onto the bowling game surface is completed, the bowling pins are vertically free standing on their assigned locations or spots on the game surface, undisturbed and ready for the first ball to be played.

In the most manual of operations, this can be achieved by simply placing each pin, by hand, onto the playing surface in its assigned location. In early times, pin boys were employed to do this.

Over time, semi-automatic bowling machines were developed and manufactured to reduce operator involvement in the operation that sets bowling pins onto the bowling lane surface. Human intervention was still necessary; the operators placed the bowling pins into the machine and manually operated the mechanism that set the bowling pins onto the lane surface.

The advent of fully automatic pinsetters has resulted in substantially reduced operator involvement as the bowling pinsetting machines are able to perform all of the functions necessary for normal play of the game, including the function that sets and releases the bowling pins onto the lane surface. It is this area of pinsetter operation that is of interest in the context of the present invention.

Bowling pinsetting machines contain bowling pin holders or supports. Depending on manufacturer make and model, said pin holders are called for example, cells, cups, chutes or buckets.

These cells, chutes or buckets are typically mounted on or attached to a structure, sometimes called a table or deck, which has vertical reciprocating motion. A bowling pin distribution system delivers bowling pins to the pin cells, one pin per cell. In the operation that sets the bowling pins onto the bowling game surface, the deck or table descends to the game surface, the pins are released and remain free standing on the game surface as the table or deck returns to its resting position above the game surface.

Bowling pinsetters heretofore have employed rather complex mechanical and electromechanical components and systems to set bowling pins onto the lane surface. This is due to the fact that the actual release of the pins from their cells is controlled and coordinated by mechanical or electromechanical pinsetter components that are external to the pin cells. These external mechanisms and devices control the motion and timing of the pin holders or supports such that they move in unison.

For example, Prior Art FIGS. 1*a*-1*e* and 2 show some of the mechanisms of the Brunswick A2 automatic pinsetter. FIGS. 1*a*-1*e* show the moving deck assembly and shows that the frame upon which the pin chutes are mounted moves back and forth as a single unit during pin release. FIG. 2 shows some of the connecting mechanisms which contribute to the motion of the moving deck. Not shown are other assembly components and mechanisms that are critical to the action of pin release, for example gear box, clutches, additional cams, cables and the like.

In this sense then, the pin holders or supports can be thought of as passive devices. That is, other than the mechanisms that deliver the pin holders to the lane surface, additional pinsettter machine mechanisms or electromechanical components outside of the pin holders or supports are necessary to actually release the pins onto the lane surface. Thus, pin holders or supports respond to the external components and mechanisms to which they are connected. From the above descriptions it can be seen that there exists a commonality in pin release design among makes and models of bowling pinsetters: that in the act of releasing pins onto the bowling lane surface, the pin holders or supports depend on pinsetter mechanical or electromechanical components outside of the pin supports or holders themselves—the pin release is "not pin cell independent". That is, when bowling pins are released from their cells or holders, timing, motion and positioning of the pin holders are dependent on pinsetter mechanisms and components that are external to the pin holders.

Bowling pin release mechanisms are controlled by mechanical or electromechanical means such as camshafts, switches, cables, levers, linkages and the like in such a way that the pin cells, cups or chutes move or operate in a coordinated fashion in response to pinsetter mechanisms or electromechanical components that are external to the pin cells themselves.

There is a need in the art, therefore, for a bowling pin release mechanism which is pin cell independent.

SUMMARY OF THE INVENTION

This device is a bowling pin release mechanism, which is used to release bowling pins onto the lane for the first ball, which is pin cell independent. As such, aside from the vertical, reciprocating motion of the frame structure on which it is mounted, does not require additional mechanical or electromechanical mechanisms or components for pin release and reset operations. The resettable pin support and release mechanisms are contained within the pin cell.

This device is meant to be a standalone release mechanism, so that, other than the mechanism that lowers it to the bowling lane surface, it does not require external mechanisms to make it operate (although it will be understood that this is not intended to exclude external mechanisms from the scope of the overall product within which the release mechanism will operate). Release of the bowling pin is caused by the mechanisms in the device contacting the bowling lane surface. The resetting of the release mechanism is caused by insertion of a bowling pin into the device.

The novel self-contained resettable bowling pin release mechanism presented herein supports a single bowling pin in preparation to be set standing on the bowling lane surface. Release mechanisms within the cell contact the bowling lane surface, are triggered or engaged to release the bowling pin from its supports onto the lane surface. When the pin is released, it is free standing on the lane surface and there is sufficient clearance within the cell so as not to disturb the bowling pin. Reset mechanisms are triggered or engaged to reset the bowling pin supports when a bowling pin is inserted into the pin cell. Thus, inserting a bowling pin into the pin cell causes the reset mechanisms to move the supports into position to support the bowling pin.

In a pinsetter machine, typically, ten such pin cell units would be mounted on a frame or structure that has vertical reciprocating motion. When the structure is stationary in the raised position above the bowling lane surface, bowling pins are inserted into the cells—one pin per cell. All pins are thus being supported within their cells. When the frame or structure is lowered to the bowling lane surface, the release mechanisms within the pin cells, acting independently of each other, are engaged, thus causing the bowling pins to be released from their cells.

When the frame is raised above the lane surface, all pins have been released and are free standing on the bowling lane surface. Inserting ten pins into the cells, one pin per cell, engages the reset mechanism in each cell causing the release mechanism to be reset, thus supporting the pin that has just been inserted into the cell.

BRIEF DESCRIPTION OF THE DRAWING

FIGS. 1*a*-1*e* show a prior art

DETAILED DESCRIPTION OF THE INVENTION

Figure 2:
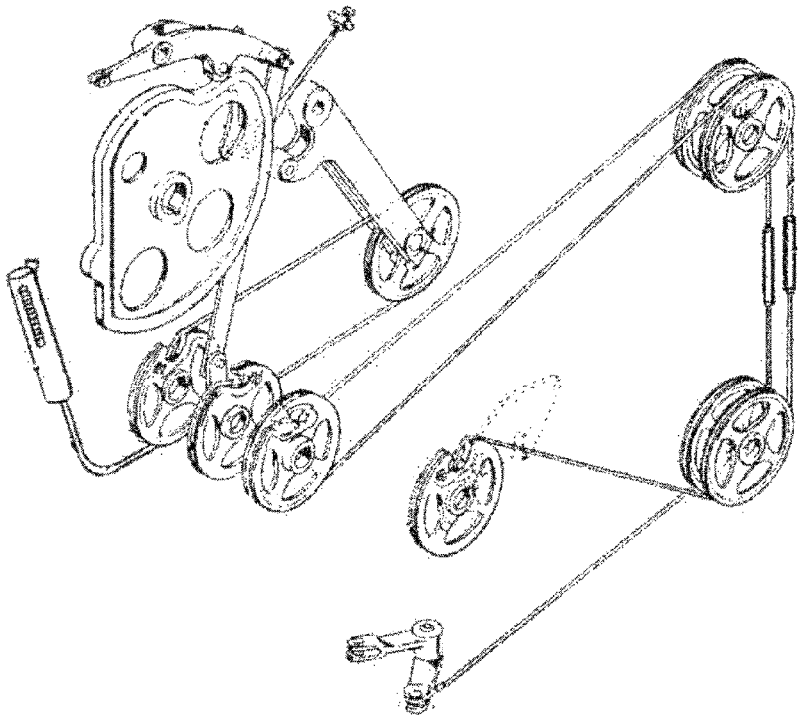
Fig. 2 PRIOR ART
FIG. 2 shows a prior art

Two embodiments of a novel bowling pin release/reset assembly are presented in this document.

Referring to the figures, the principal components of the device are: bowling pin tube 12, bowling pin supports 13 and 14, stop tab 15, release actuator 16, release linkage assembly 17, reset lever 18, reset linkage assembly 20, reset actuator 21, and reset return spring 19. The components are mounted on a frame.

Pin supports 13 and 14 are rectangular surfaces. Material and thickness are such that when constructed as defined below, they will support a single bowling pin without undue flexing.

Figure 9:
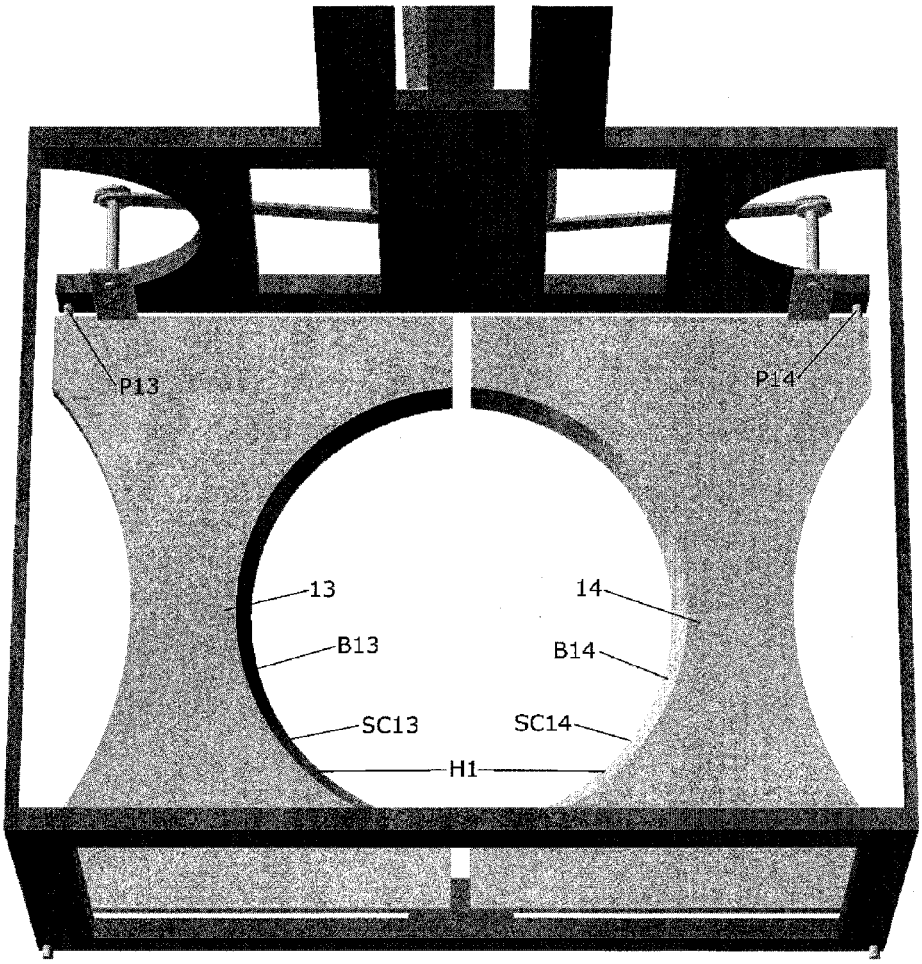
FIG. 9 shows pin supports 13 and 14 in pin support position.
Figure 11:
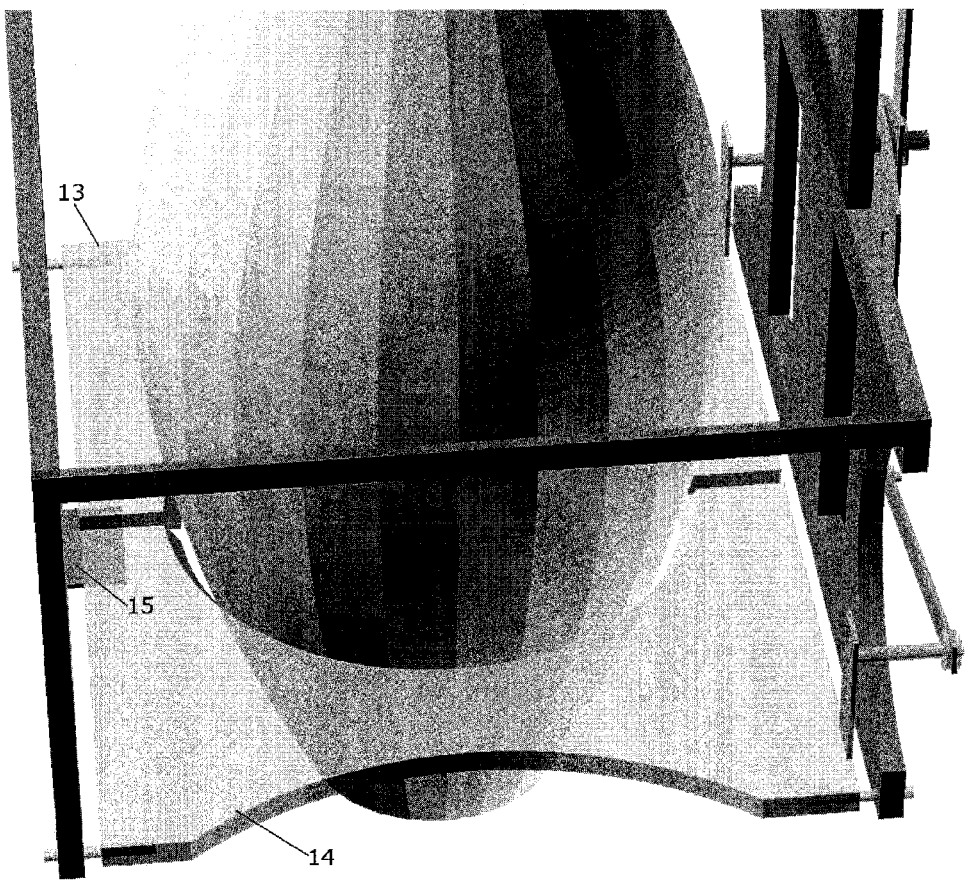
FIG. 11 shows bowling pin being supported. Notice stop tab 15 preventing rotation of pin supports beyond horizontal.
Figure 12:
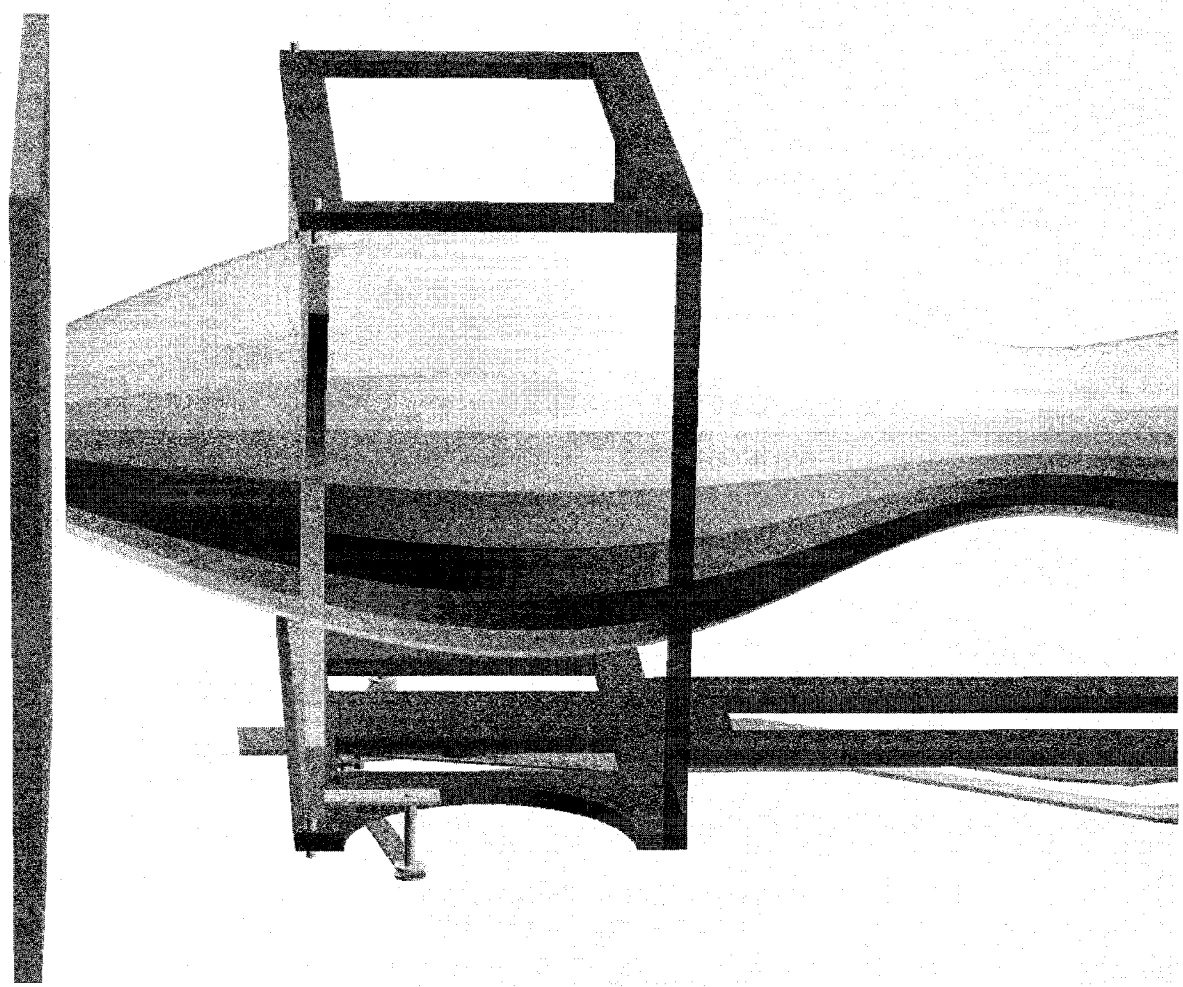
FIG. 12 shows side view of bowling pin being supported by pin supports 13 and 14.

Pin supports 13 and 14 each have a beveled B13 and B14, somewhat semi-circular cutout SC13 and SC14 along their inside edges, as shown in FIG. 9. Bevels B13 and B14 conform slightly to the slope of the lower portion of a bowling pin, as shown in FIG. 11. Pin supports 13 and 14 are configured in such a way that when they are in pin support position, shown in FIG. 9, semi-circular cutouts SC13 and SC14 form a circular hole, H1. The diameter of circular hole H1 formed by pin supports 13 and 14 is smaller than the diameter of the fattest part of the lower portion of a bowling pin, and is large enough that the bottom of the bowling pin extends beyond (below) pin supports 13 and 14, as shown in FIG. 11 and FIG. 12.

Figure 3:
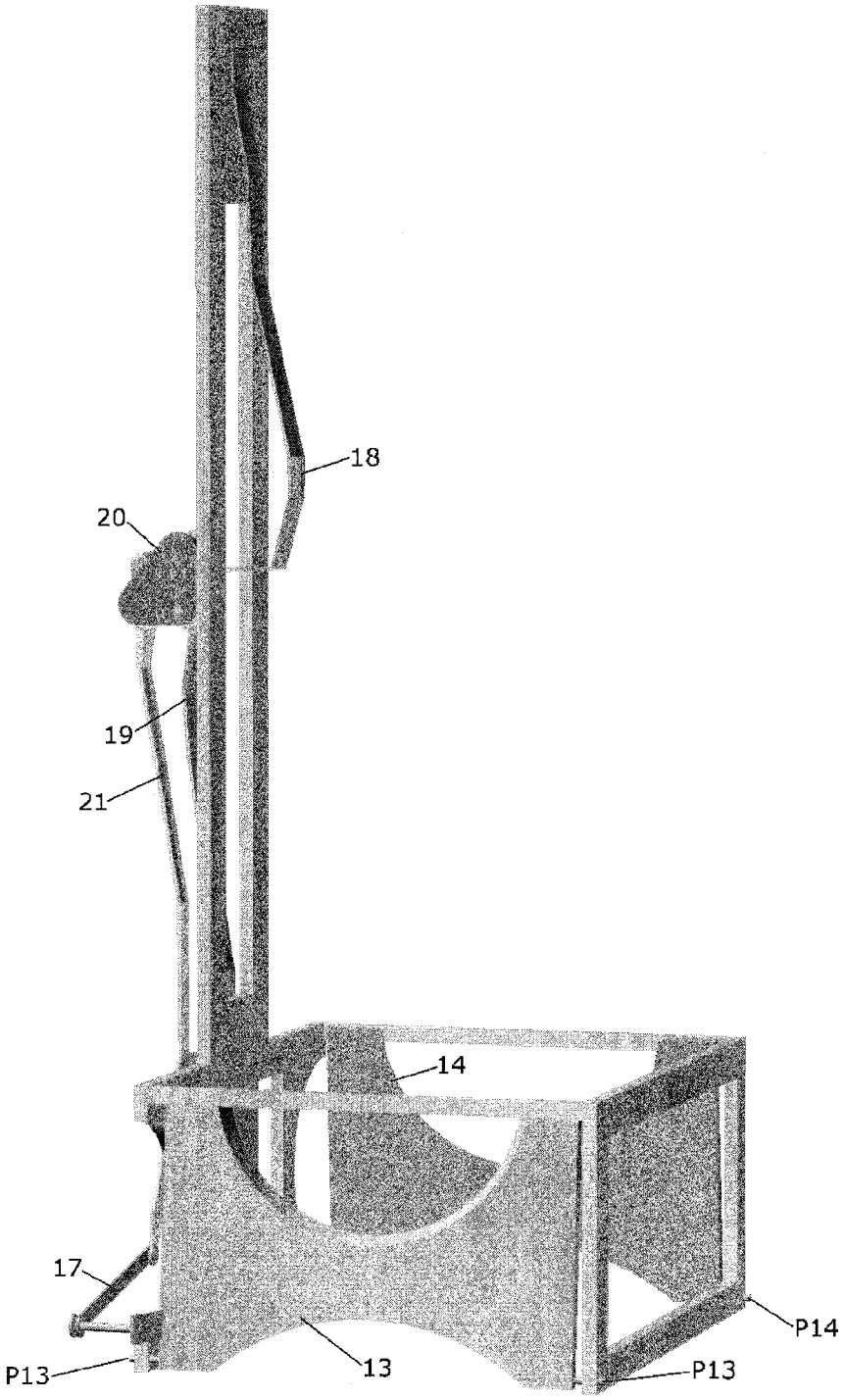
FIG. 3 is a right front perspective of the device in the pin release position, with pin tube 12 removed, showing pivot locations P13 and P14.
Figure 4:
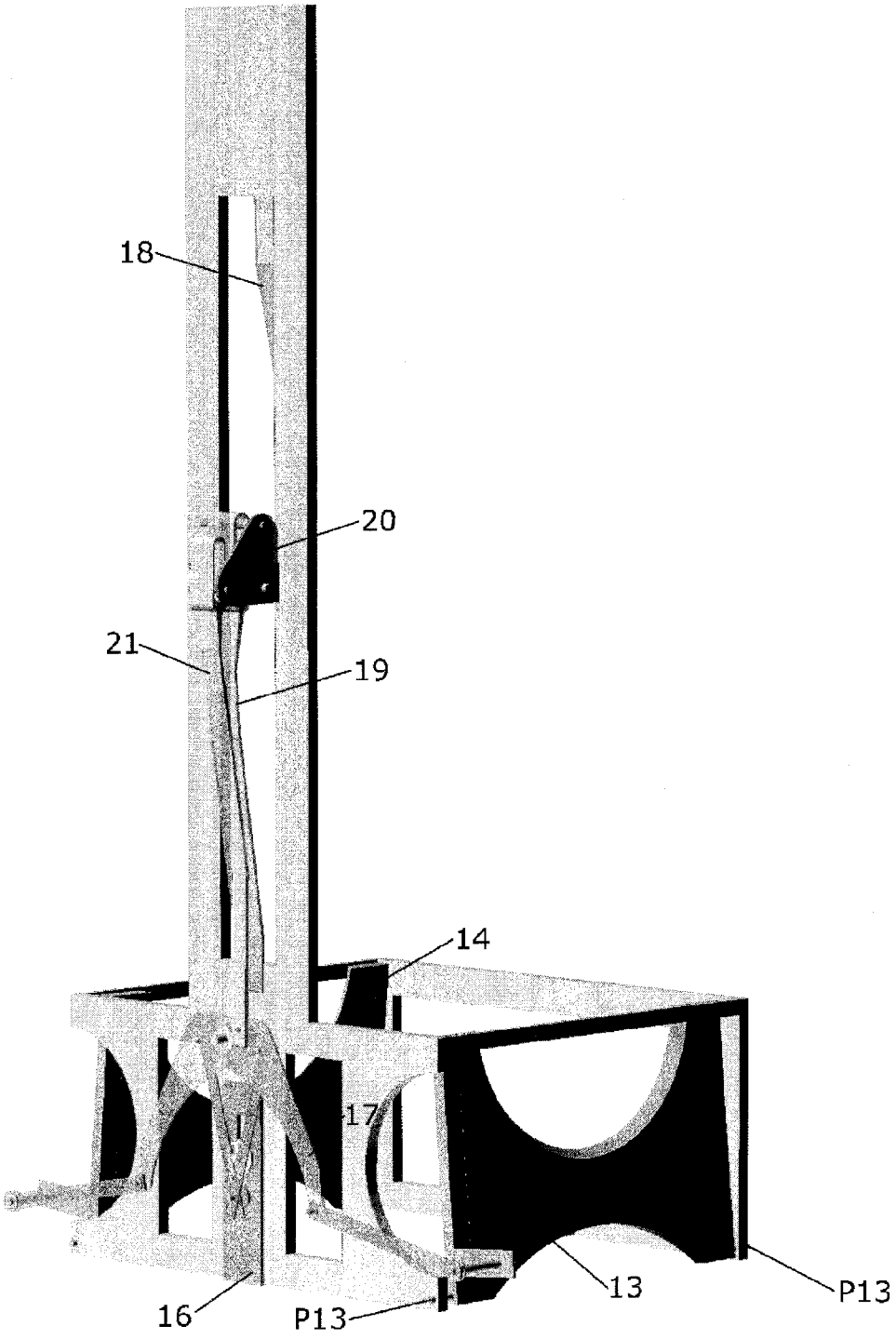
FIG. 4 is a right rear perspective of the device in the pin release position, with pin tube 12 removed, showing pivot location P13.
Figure 5:
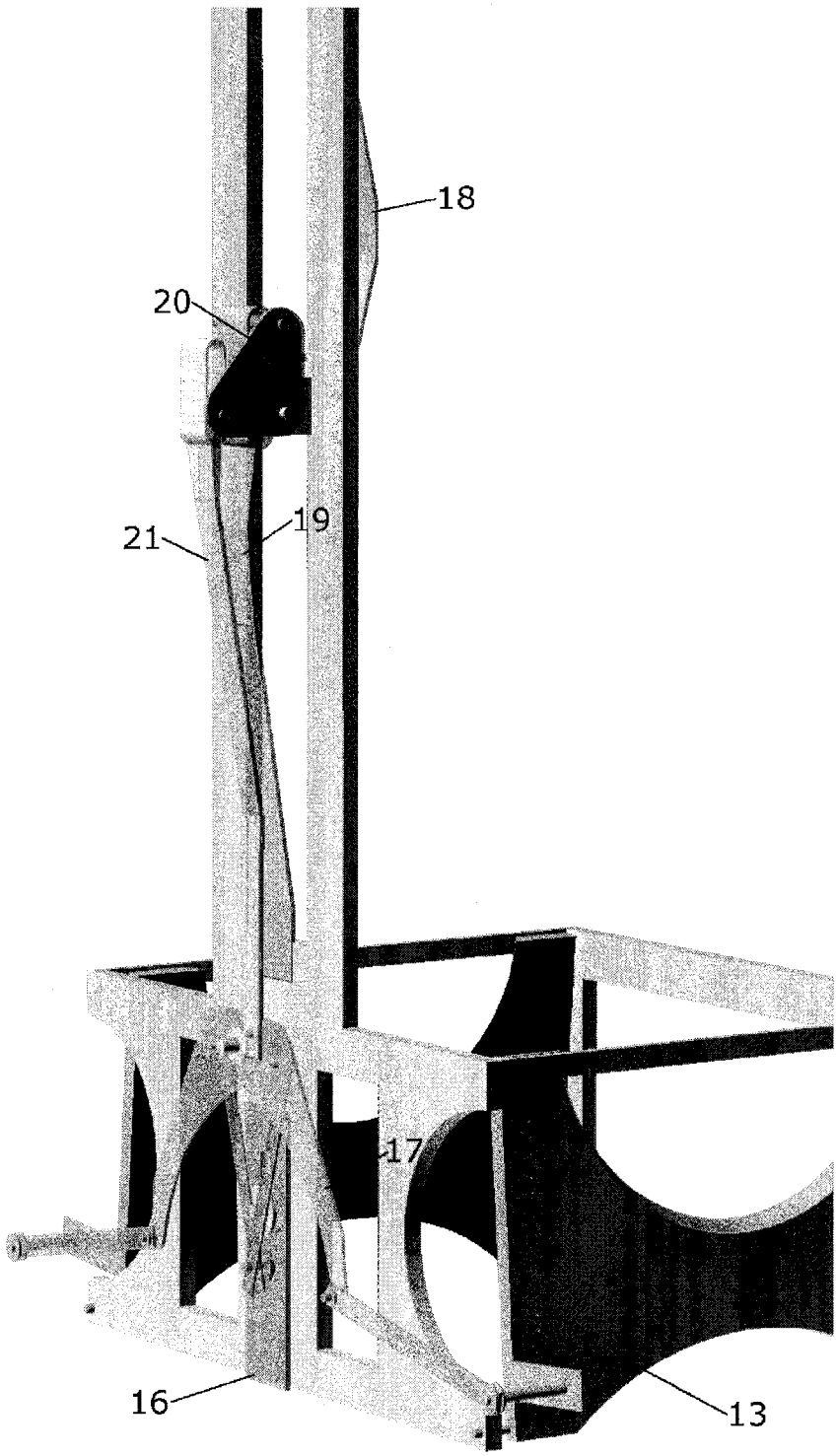
FIG. 5 is a right rear, detailed perspective of the device in the pin release position, with pin tube 12 removed, which shows release actuator 16, release linkage assembly 17, reset actuator 21, reset return spring 19, pin support 13, release lever 18 and reset linkage 20.
Figure 6:
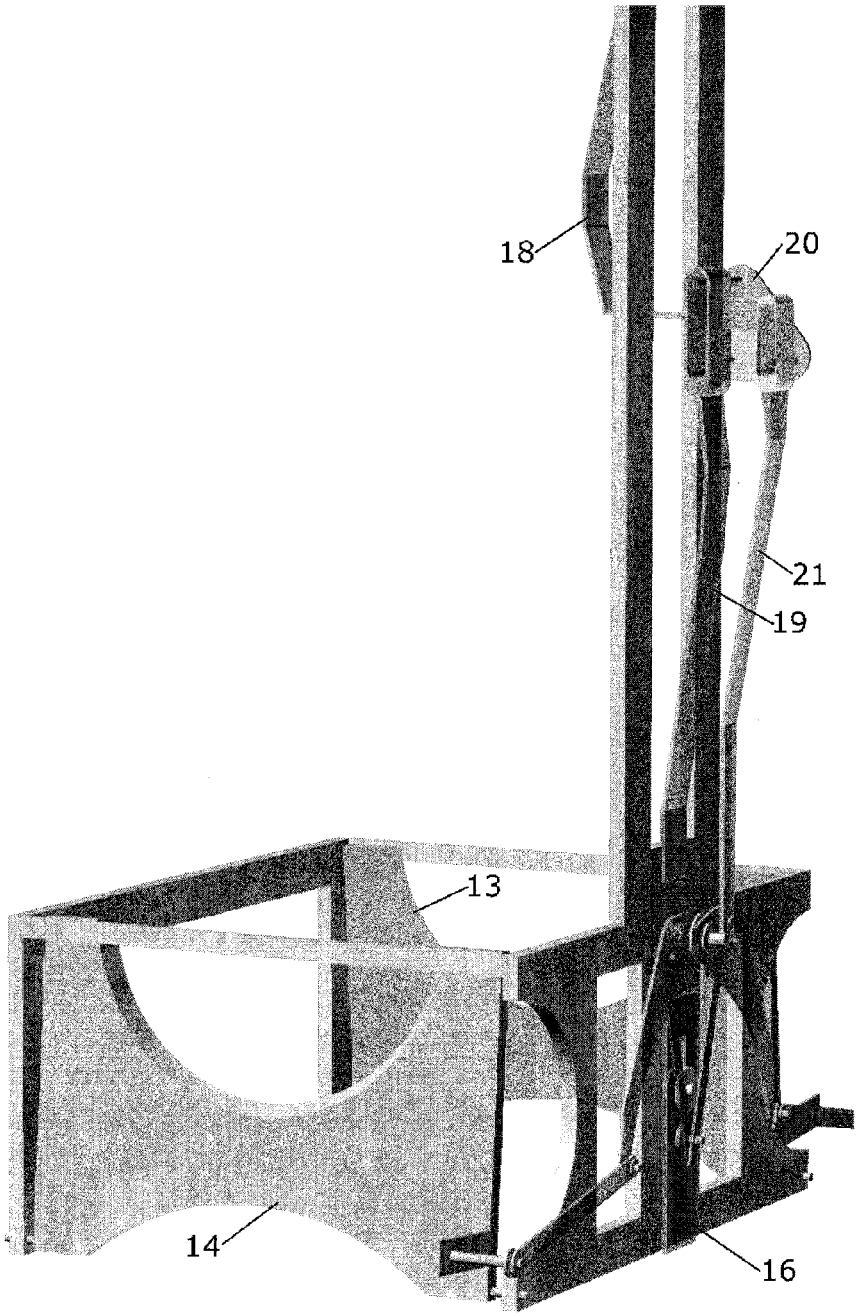
FIG. 6 is a left rear perspective of the device in the pin release position, with pin tube 12 removed.
Figure 7:
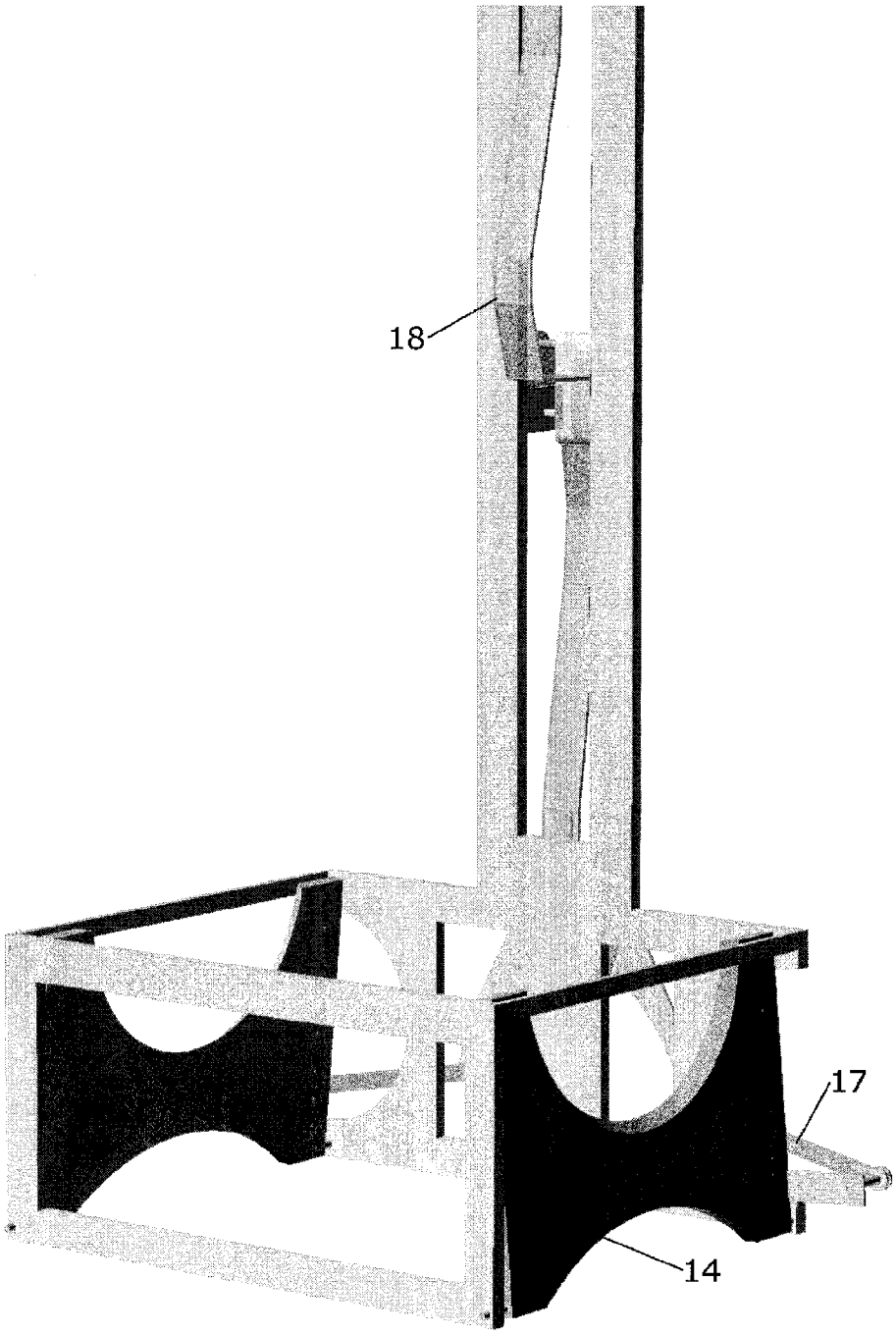
FIG. 7 is a left front perspective of the device in the pin release position, with pin tube 12 removed.
Figure 8:
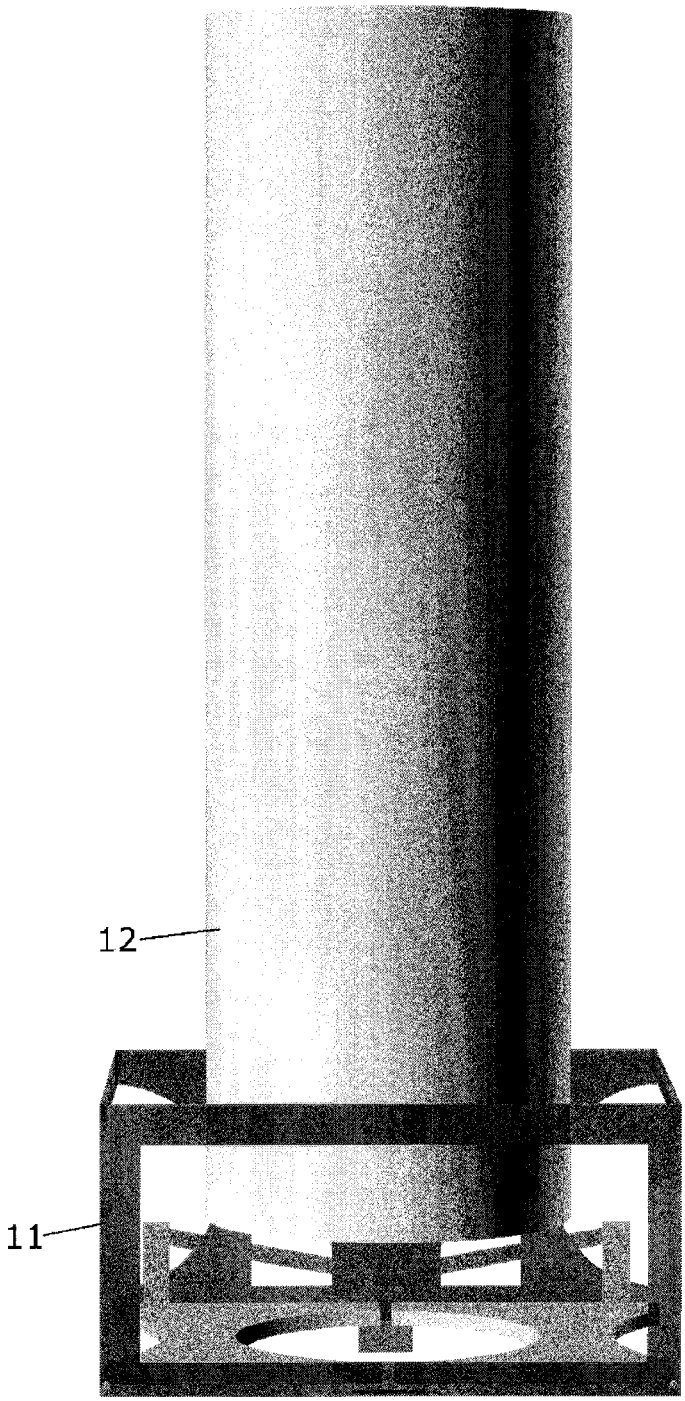
FIG. 8 is a front perspective showing pin cell 11 with pin tube 12 in place.

Pin supports 13 and 14 are pivotally mounted at P13 and P14, as shown in FIG. 3 and FIG. 9. Pivot locations P13 and P14 enable pin supports 13 and 14 to freely rotate upward and outward during pin release operation and inward and downward during the reset operation.

Figure 10:
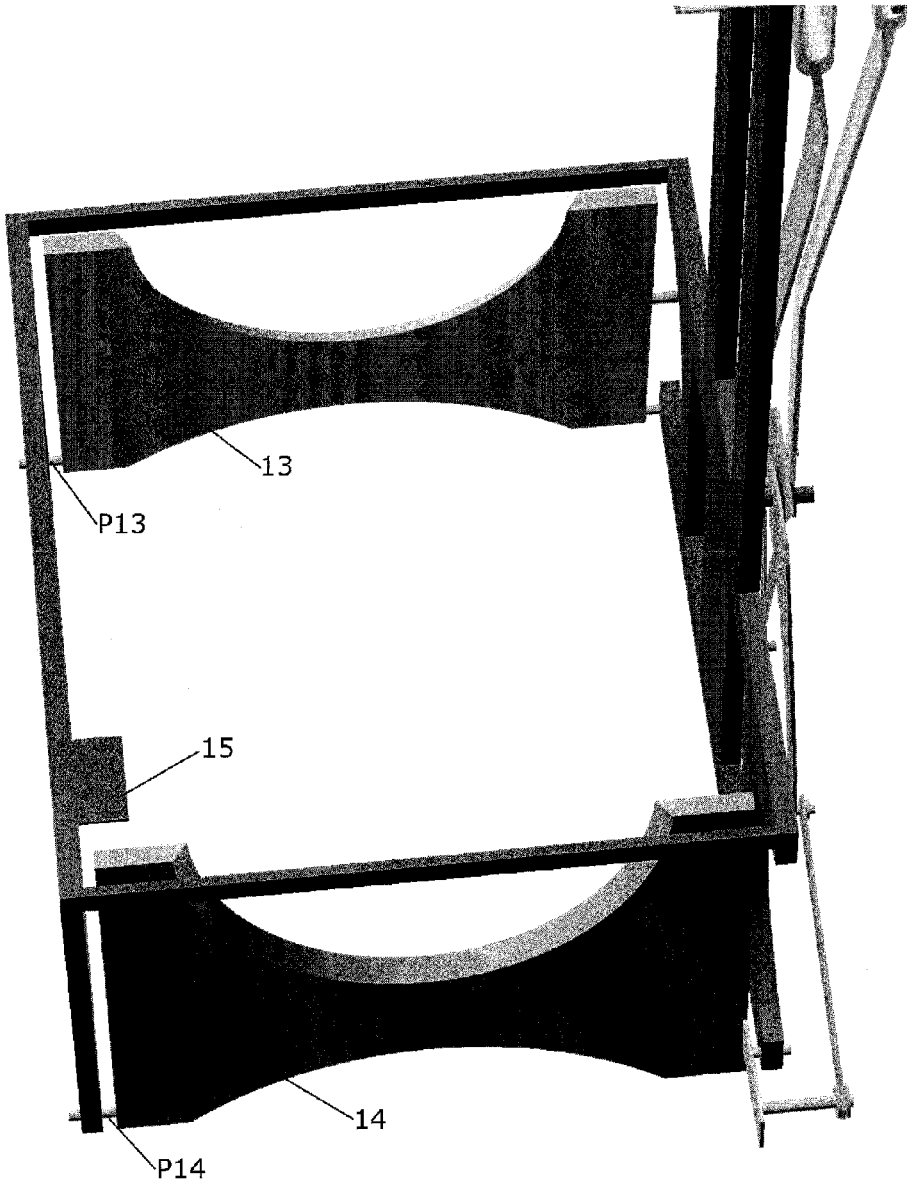
FIG. 10 shows pin supports 13 and 14 in pin release position.
Figure 24:
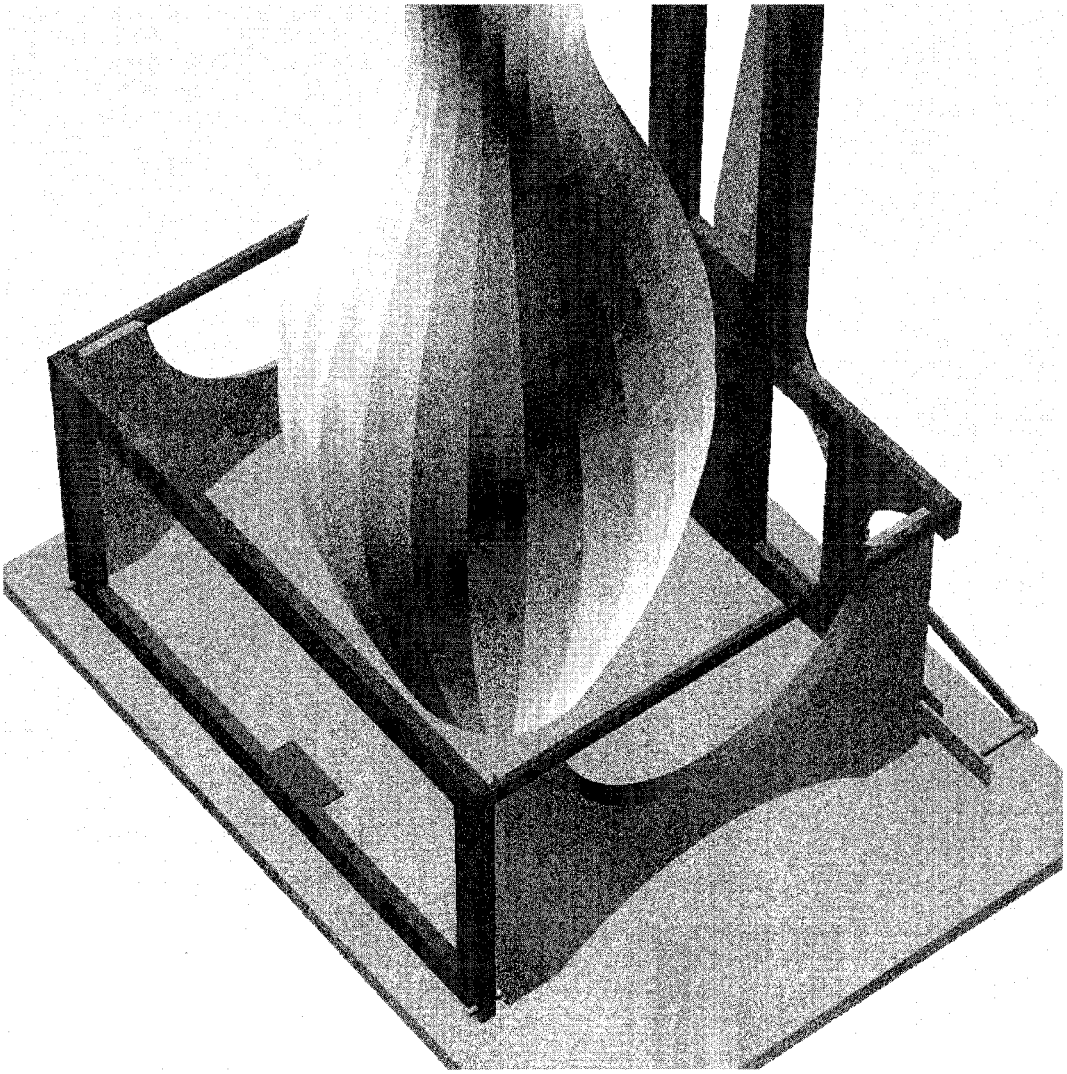

When pin supports are in pin release position, there is sufficient clearance such that pin cell 11 components do not interfere with released bowling pin during completion of release operation, FIG. 10 and FIG. 24. The phrase 'maximum outward rotation' will be used to refer to this required clearance. When pin supports 13 and 14 are in pin support position, support stop tab 15 keeps pin supports 13 and 14 in pin support position, FIG. 10, FIG. 11.

FIG. 9 shows pin supports 13 and 14 in pin support position. Notice the slight bevels B13 and B14 on the inner semi-circular surfaces SC13 and SC14 of pin supports 13 and 14. Bevels B13 and B14 serve to somewhat match the curvature of the bottom part of a bowling pin when it is being supported. FIG. 10 shows pin supports 13 and 14 in pin release position, stop tab 15 is also shown. FIGS. 11-12 show bowling pin being supported by pin supports 13 and 14.

Release Operation

First Embodiment

Figure 13:
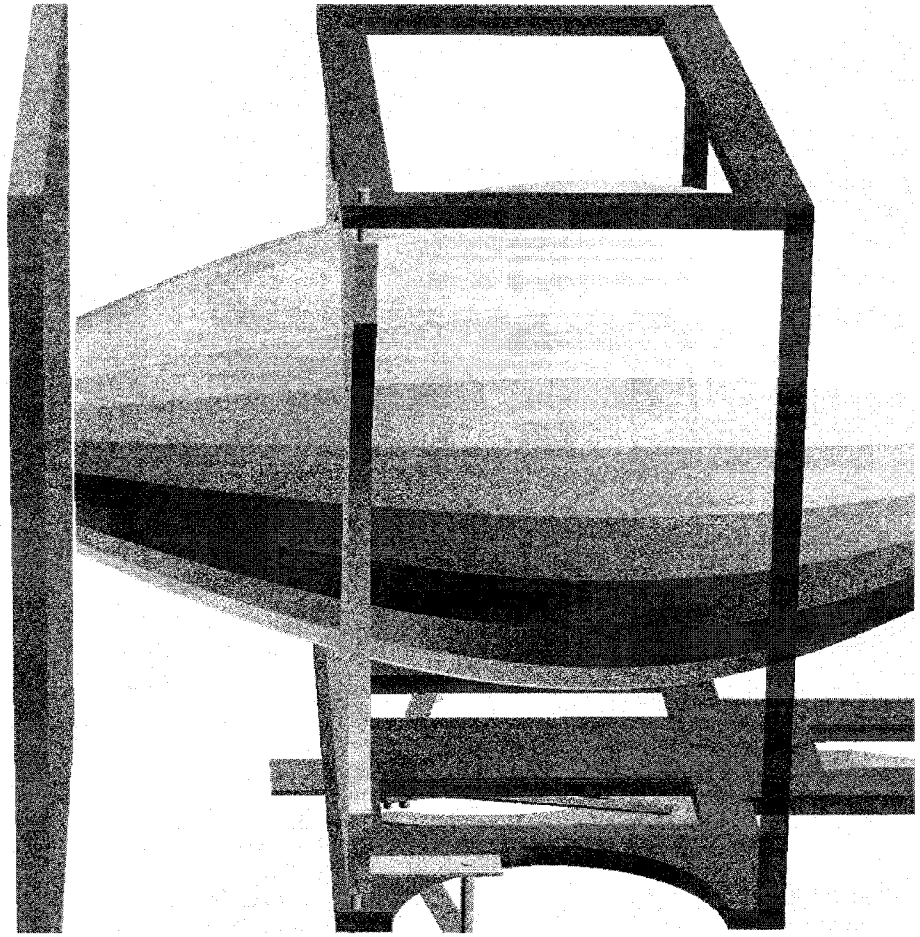
FIGS. 13-24 show the steps in the release operation of a first embodiment of the invention.
Figure 14:
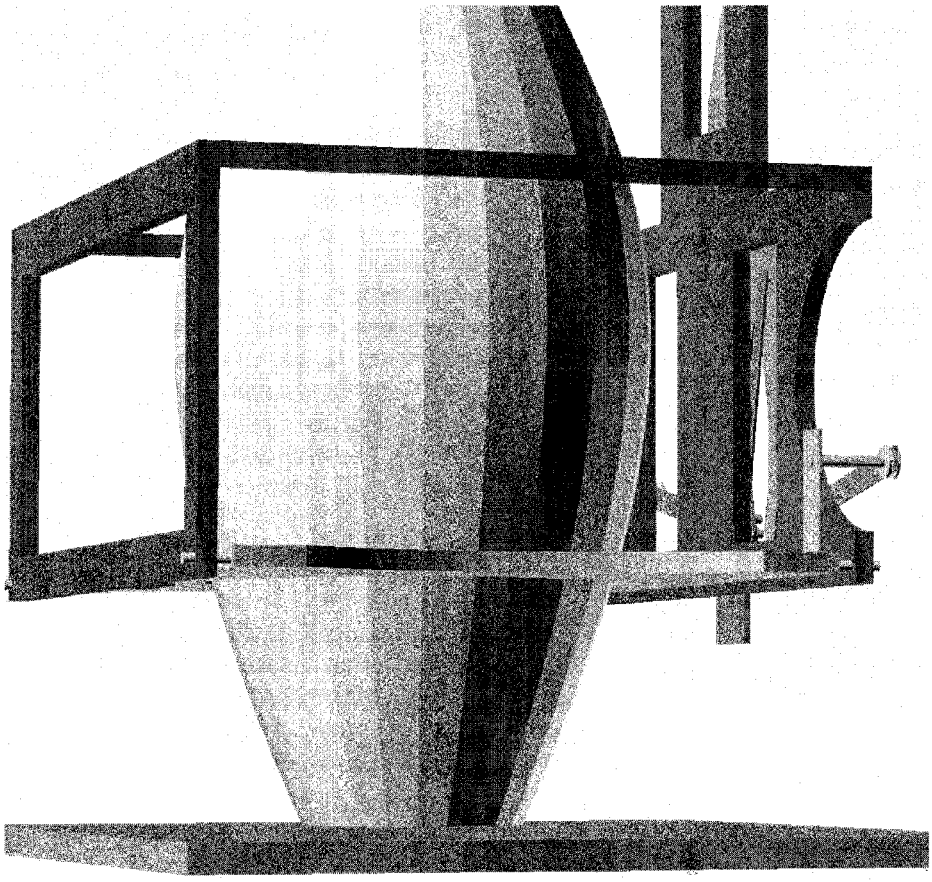

Referring to FIGS. 13-24, assume the bowling pin cell 11 is mounted to a frame structure, or table that can be lowered to and raised from the bowling lane surface. With the table in the raised position and pin supports 13 and 14 in the horizontal, pin support position, a pin is placed into pin tube 12. Support stop tab 15 prevents unwanted downward rotation of supports 13 and 14. Supported bowling pin and release actuator 16 both extend below pin cell 11. However, the pin extends a greater distance below release actuator 16. In this configuration the pin is supported in pin cell 11 by supports 13 and 14, and is ready to be released, as shown in FIG. 13.

Figure 15:
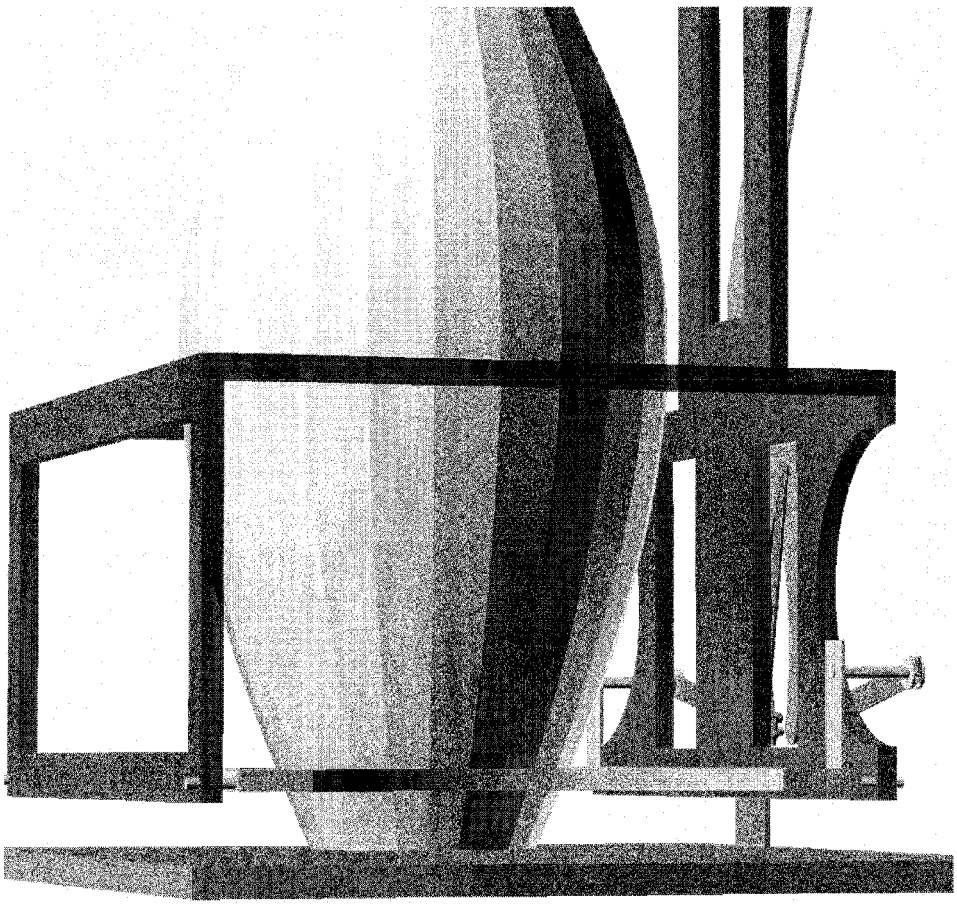
Figure 16:
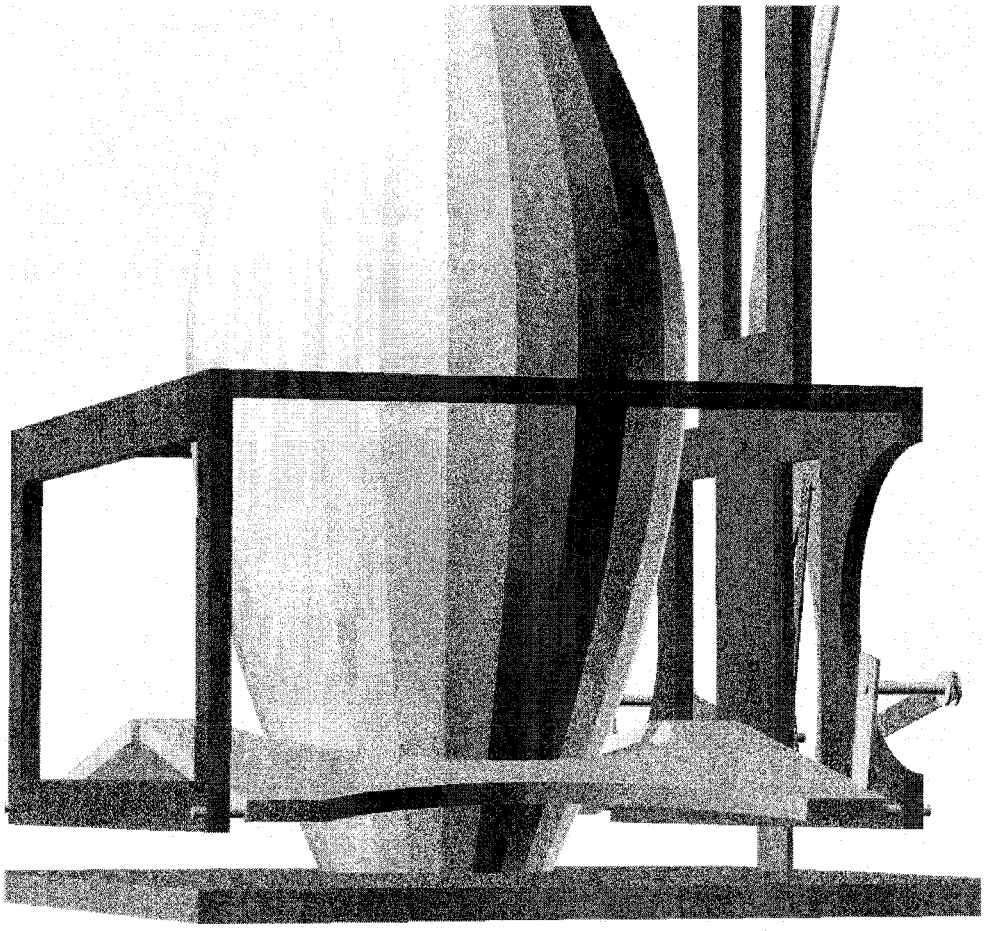
Figure 17:
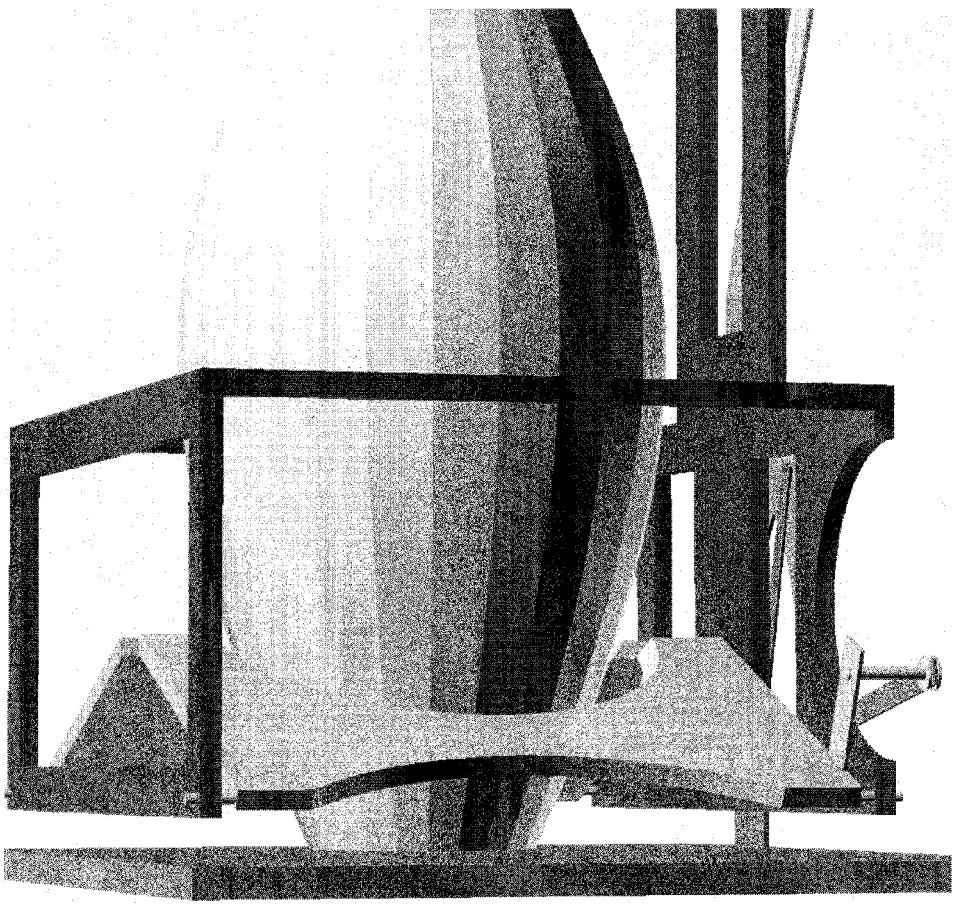
Figure 18:
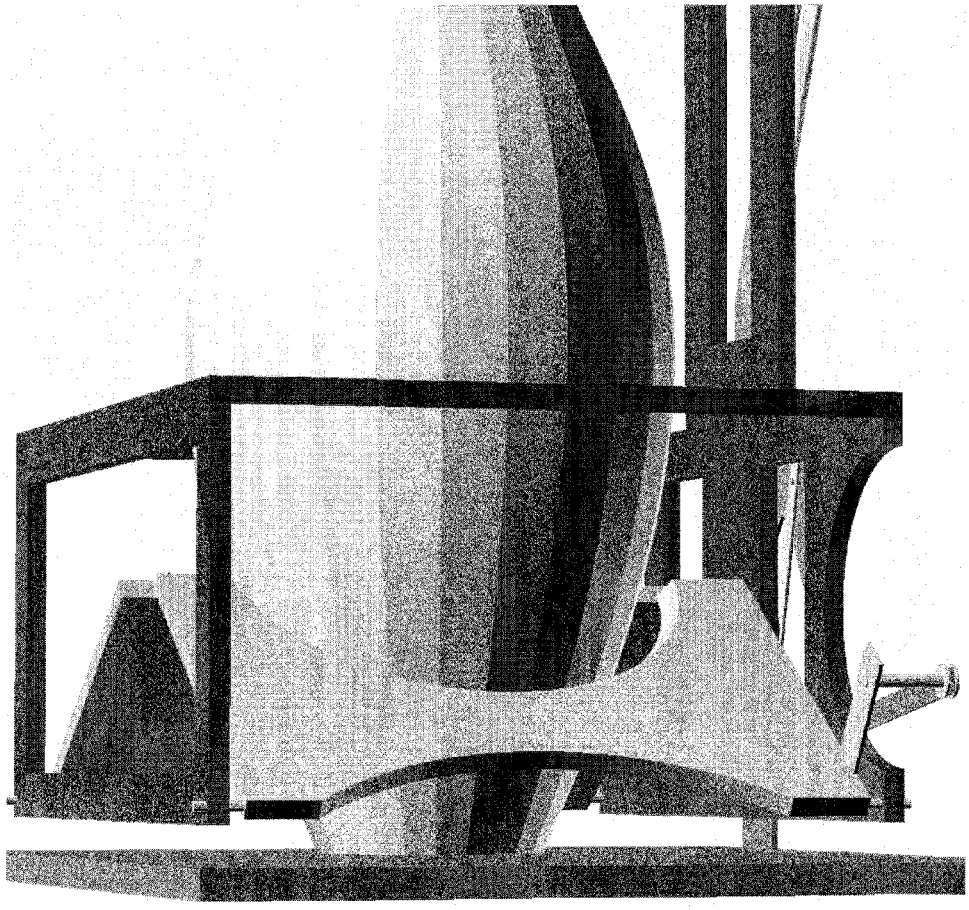
Figure 19:
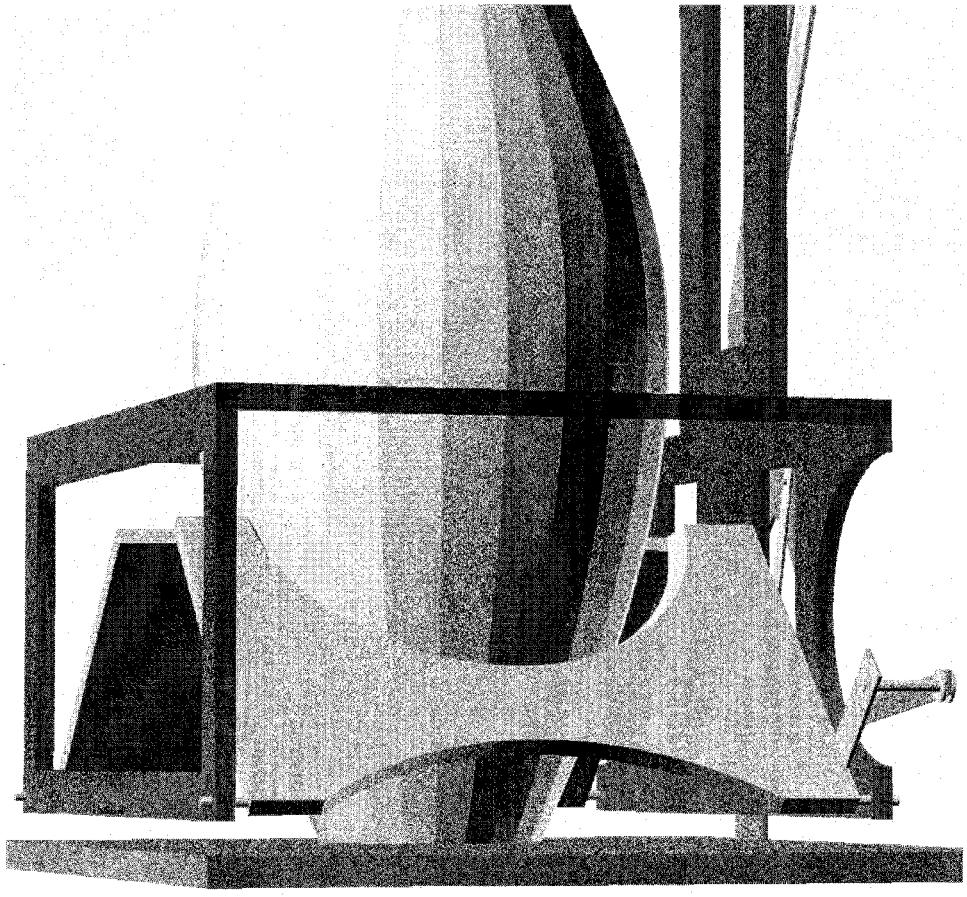
Figure 20:
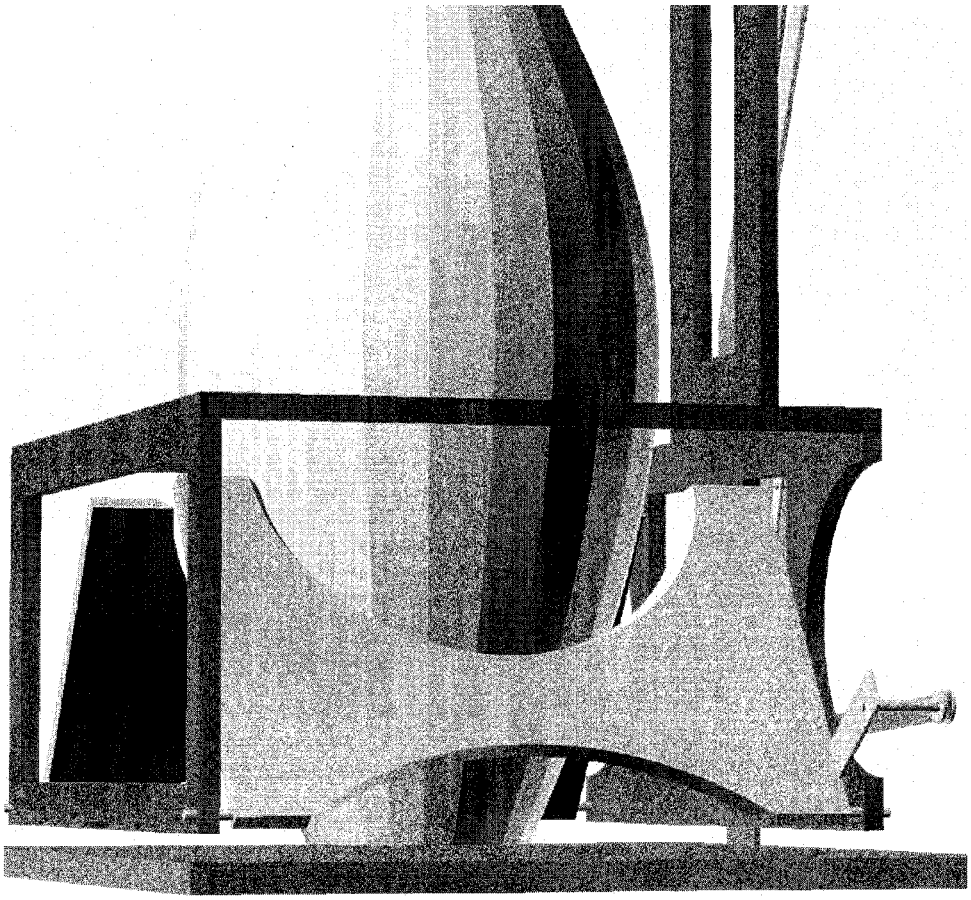
Figure 21:
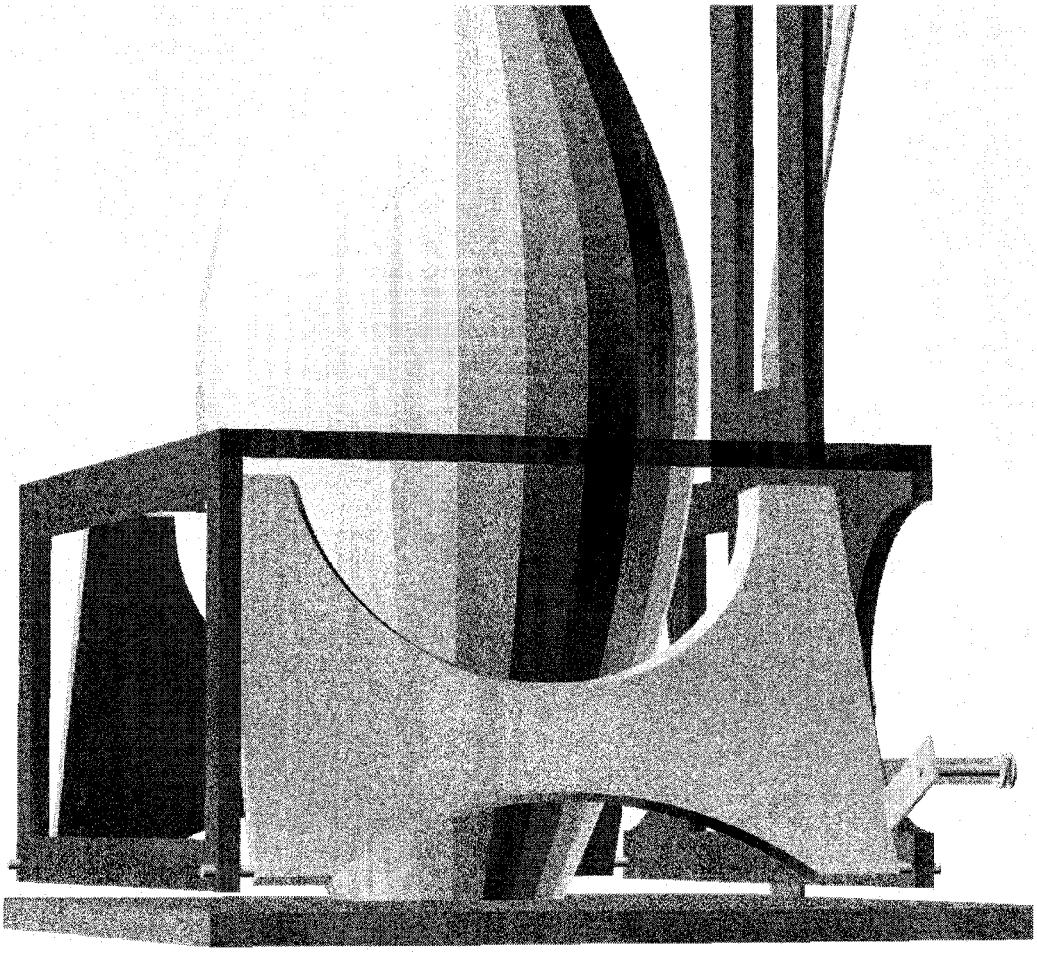
Figure 22:
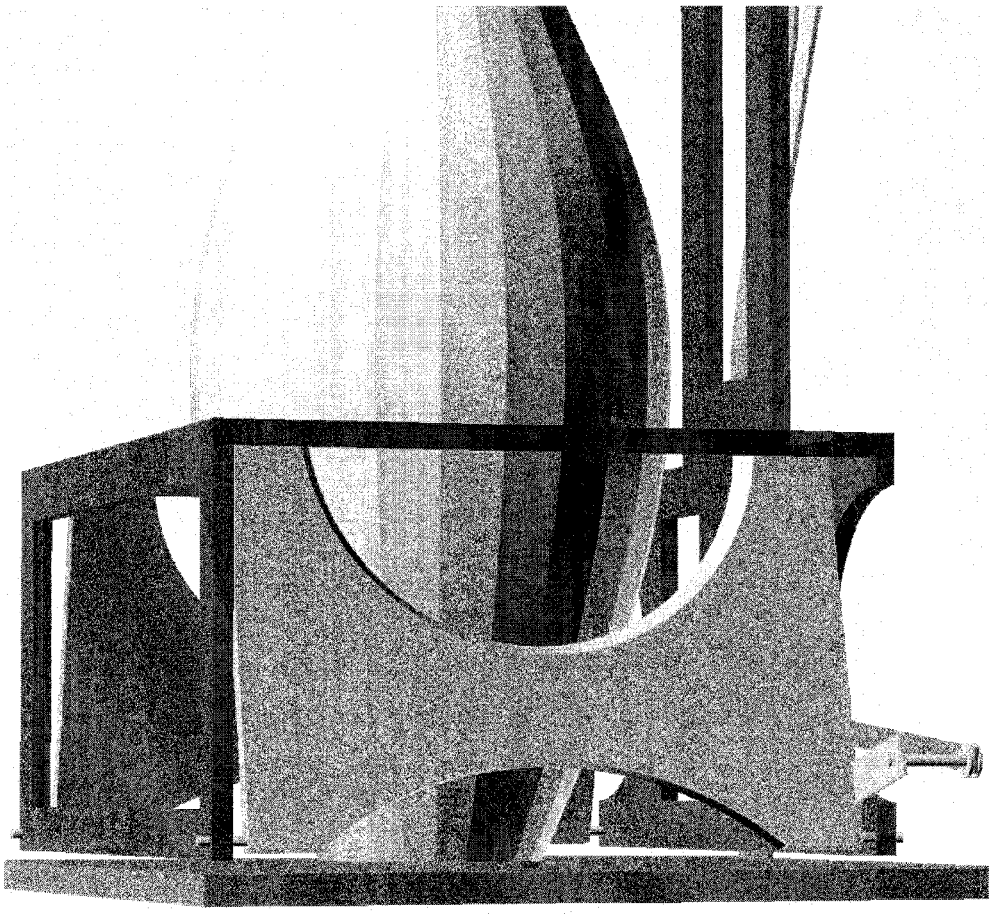
Figure 23:
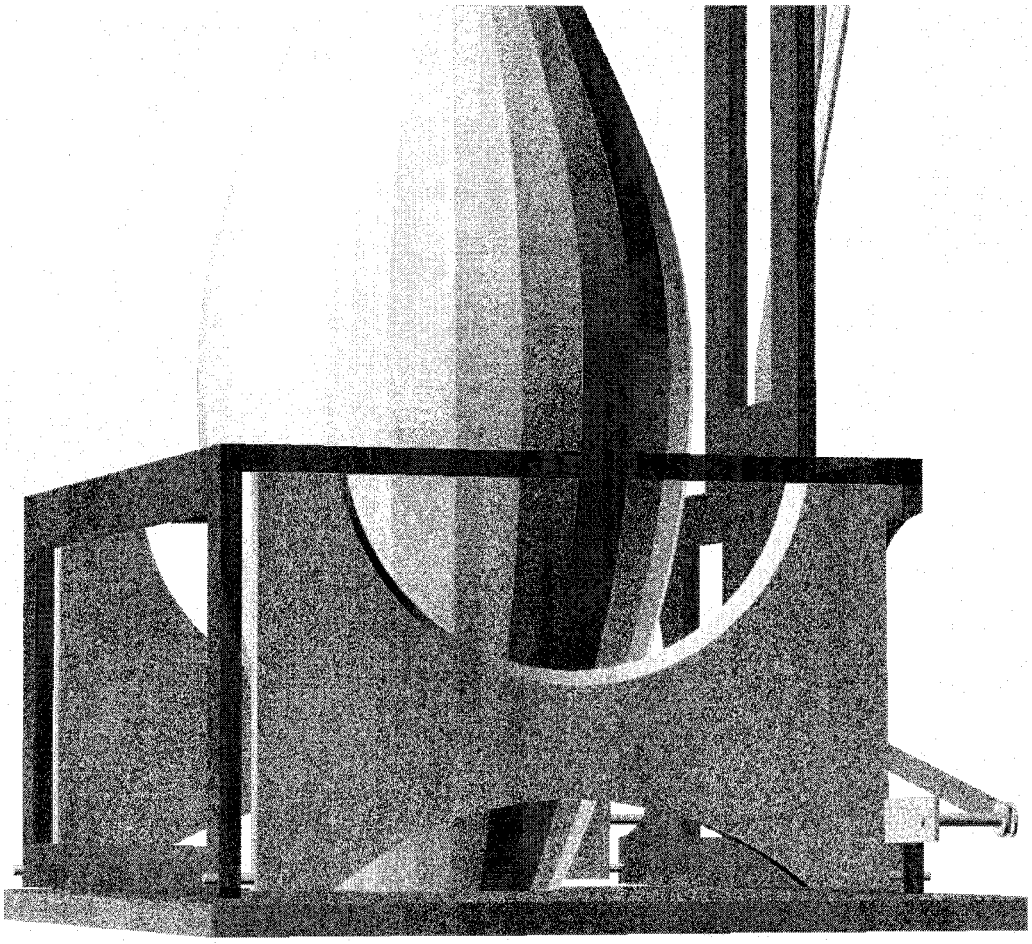

When the table is lowered to the lane surface, the bowling pin contacts the lane surface before release actuator 16. Further downward travel causes the pin to be free standing, no longer supported by supports 13 and 14, FIG. 14. Continued downward table travel causes release actuator 16 to contact the lane surface, as shown in FIG. 15. Release actuator 16 engages release linkage assembly 17 causing supports 13 and 14 to begin outward rotation, as shown in FIG. 16.

Outward rotation of supports 13 and 14 continues as the table continues downward travel. During this continued outward rotation of supports 13 and 14, there is sufficient clearance that supports 13 and 14 do not disturb the bowling pin that is free standing on the lane surface, as shown in FIGS. 16-23.

When the table has reached maximum downward travel and pin cell 11 is on the lane surface, supports 13 and 14 are in release position, that is, they have reached maximum outward rotation and the bowling pin is free standing on the bowling lane surface completely free of pin cell 11 components, as shown in FIG. 24.

Further, when the table structure ascends above the lane surface, free standing bowling pin is not disturbed by pin cell 11 or any of its components. Bowling pin is considered released and ready for play of the game.

Reset Operation

First Embodiment

Figure 25:
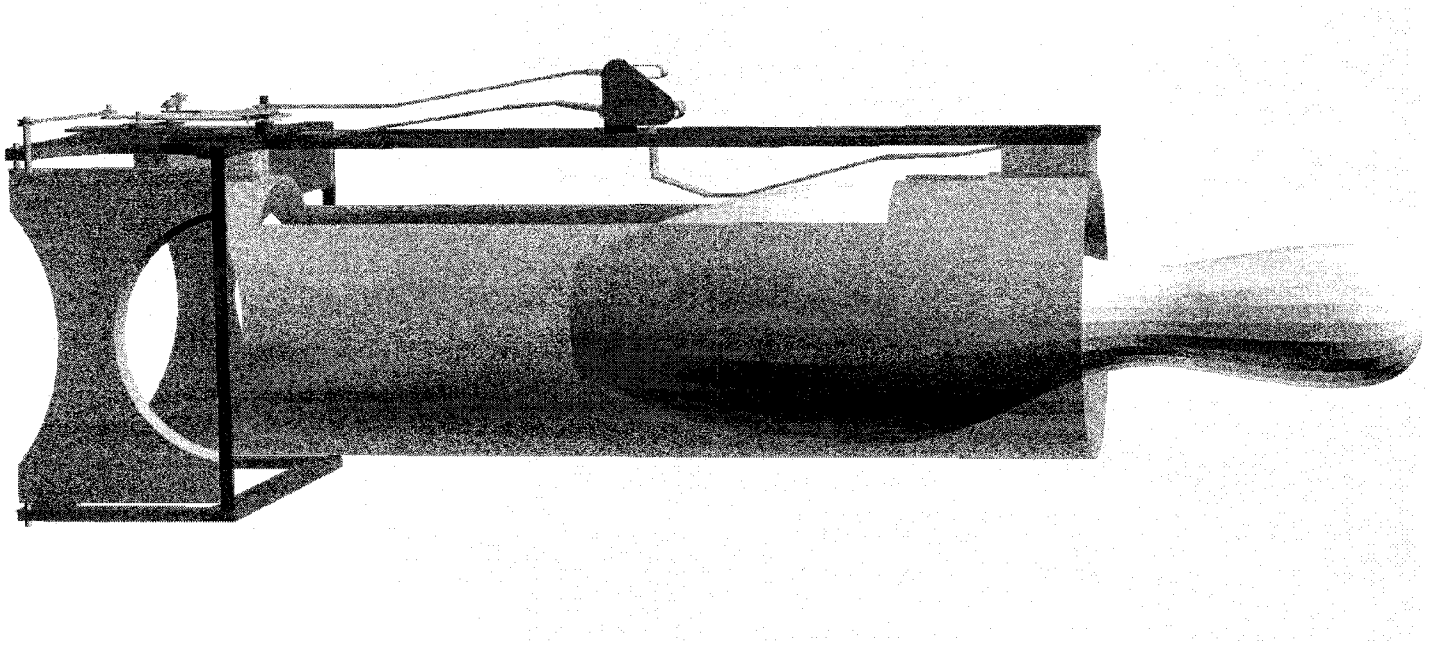
FIGS. 25-33 show the steps in the reset operation of a first embodiment of the invention.

Referring to FIGS. 25-33, assume pin supports 13 and 14 are in the release position, that is, their maximum outward rotation. The bowling pin is inserted into pin tube 12, as shown in FIG. 25.

Figure 26:
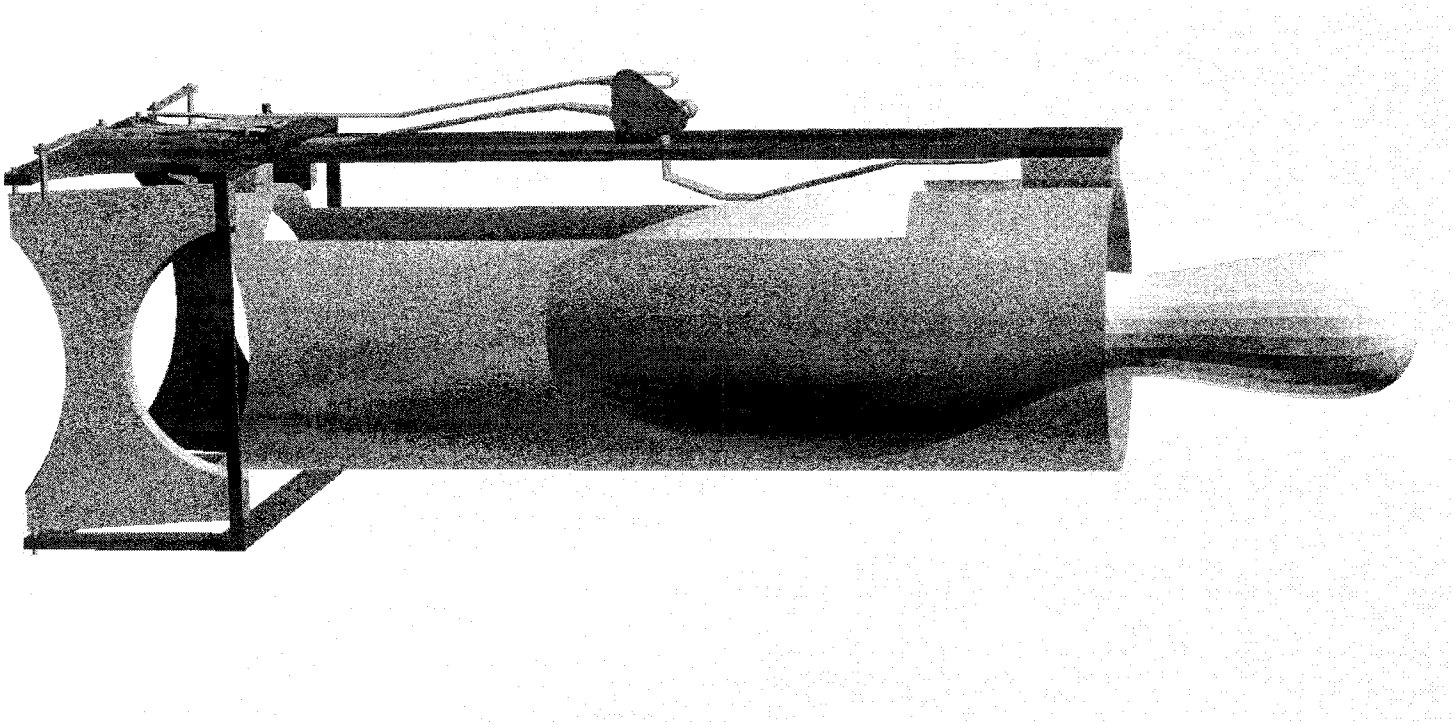

As pin travels through pin tube 12, fattest part of pin contacts reset lever 18, as shown in FIG. 26. Reset lever 18 engages reset linkage 20.

Figure 27:
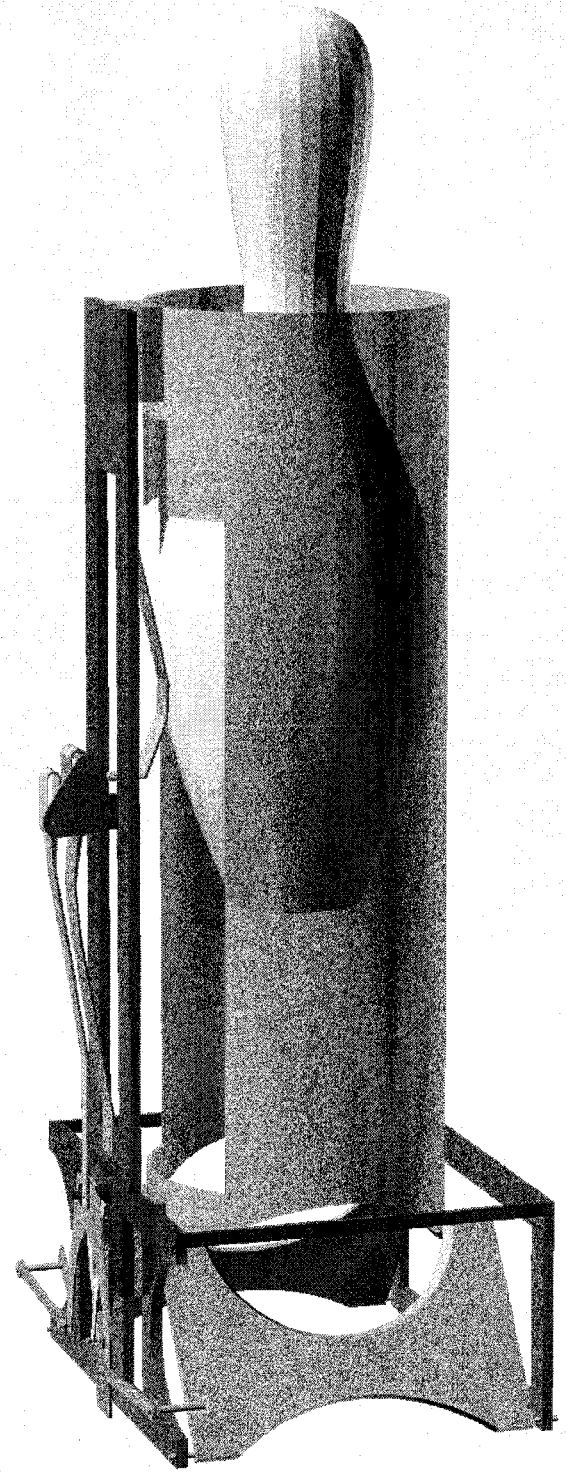
Figure 28:
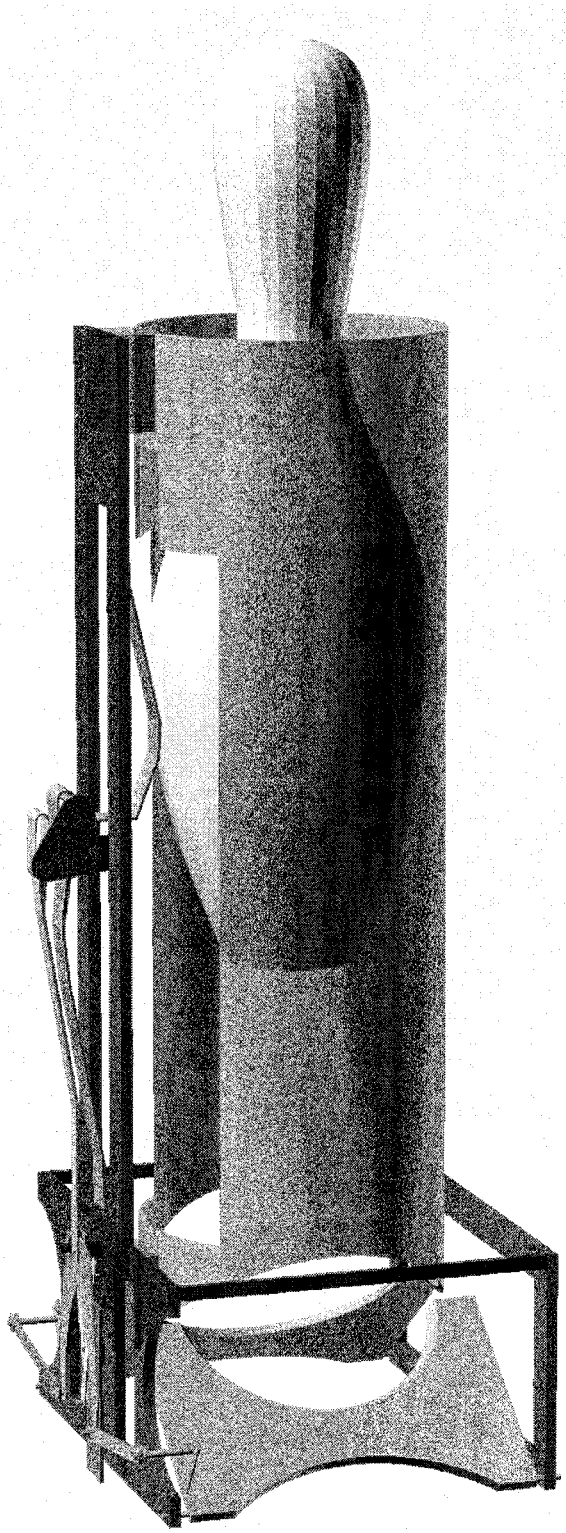
Figure 29:
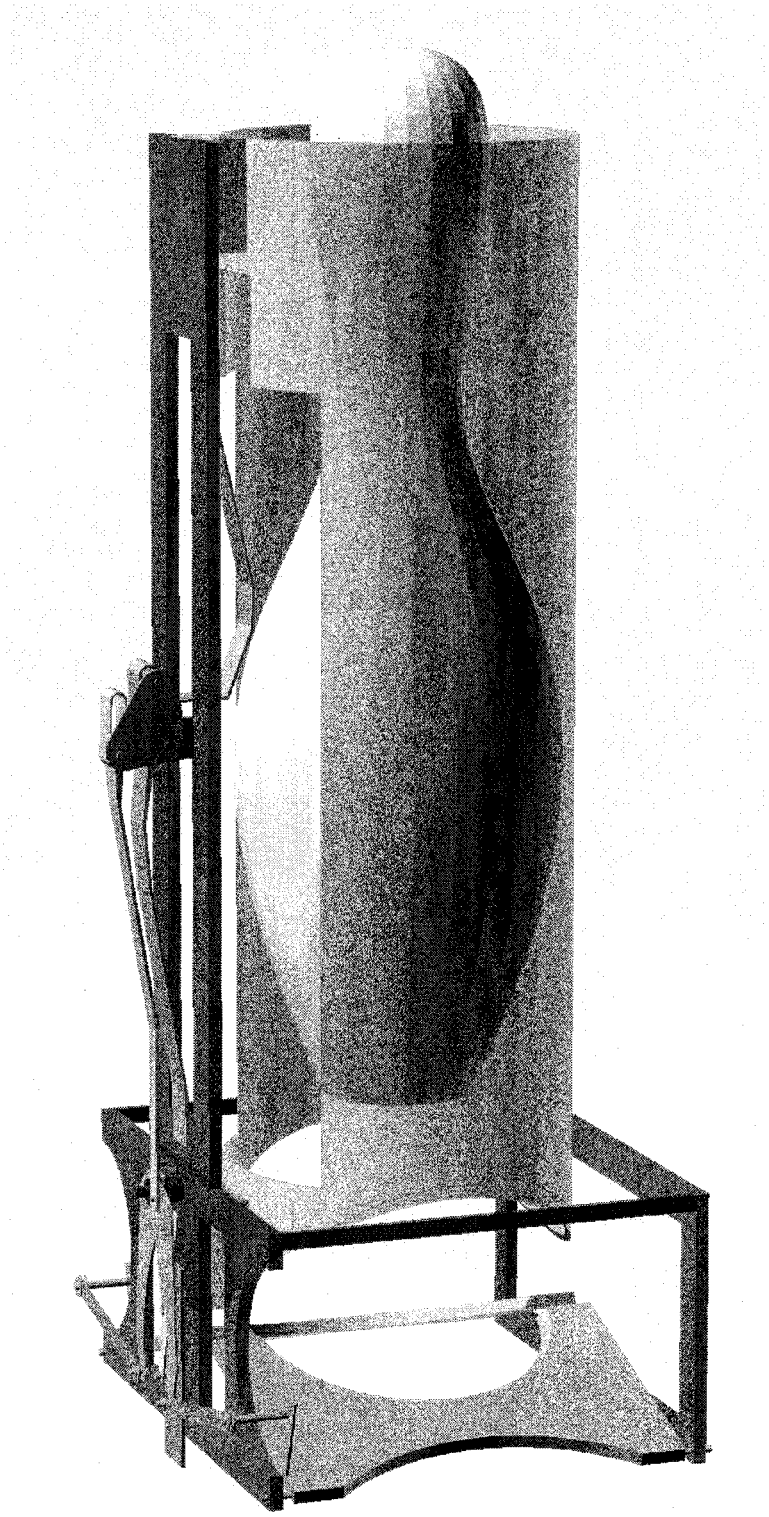
Figure 30:
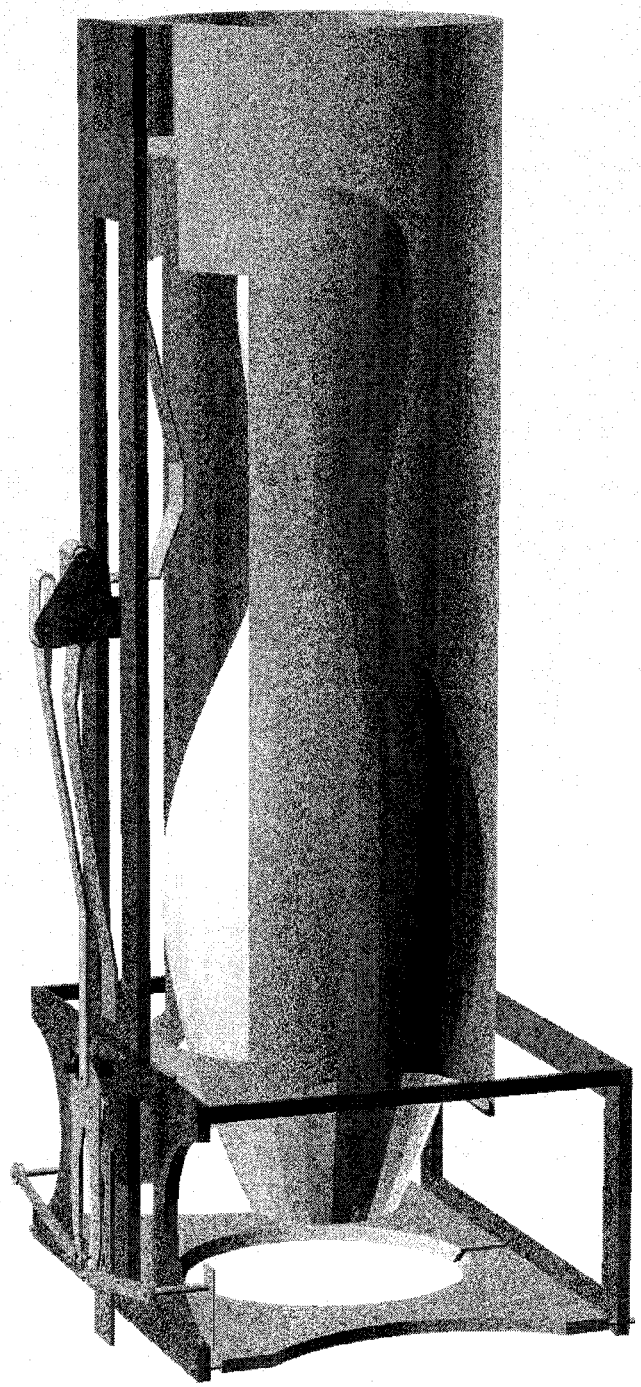

Reset linkage 20 begins to rotate, as shown in FIG. 27. Rotation of reset linkage 20 causes reset actuator 21 to move downward. Reset actuator 21 thus engages release linkage assembly 17 at pivot location P17, causing pin supports 13 and 14 to begin inward rotation toward their pin support positions, as shown in FIGS. 28-30.

There is sufficient clearance that bowling pin downward travel does not interfere with inward rotation of pin supports 13 and 14. Pin supports 13 and 14 inward rotation stops at pin support position by stop tab 15 (not visible in FIGS. 25-33).

Figure 31:
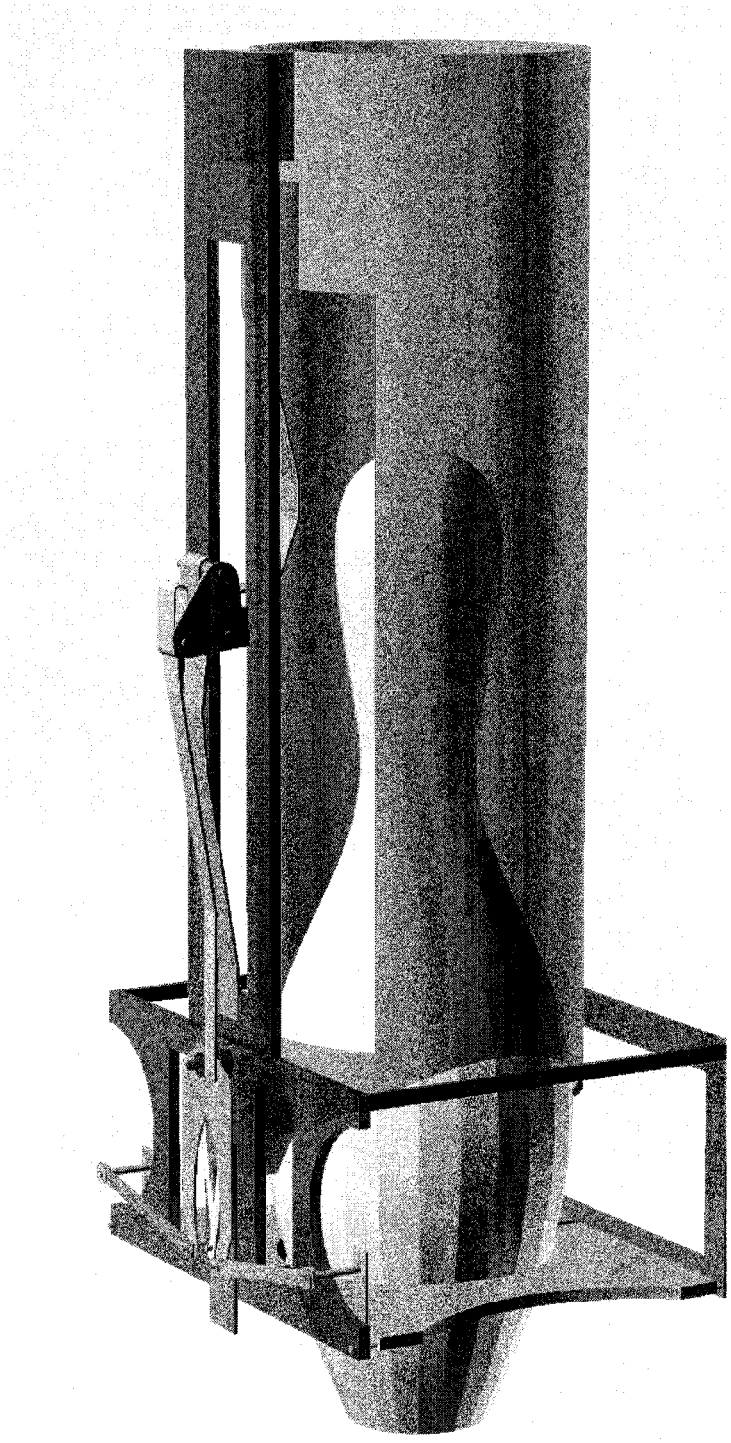
Figure 32:
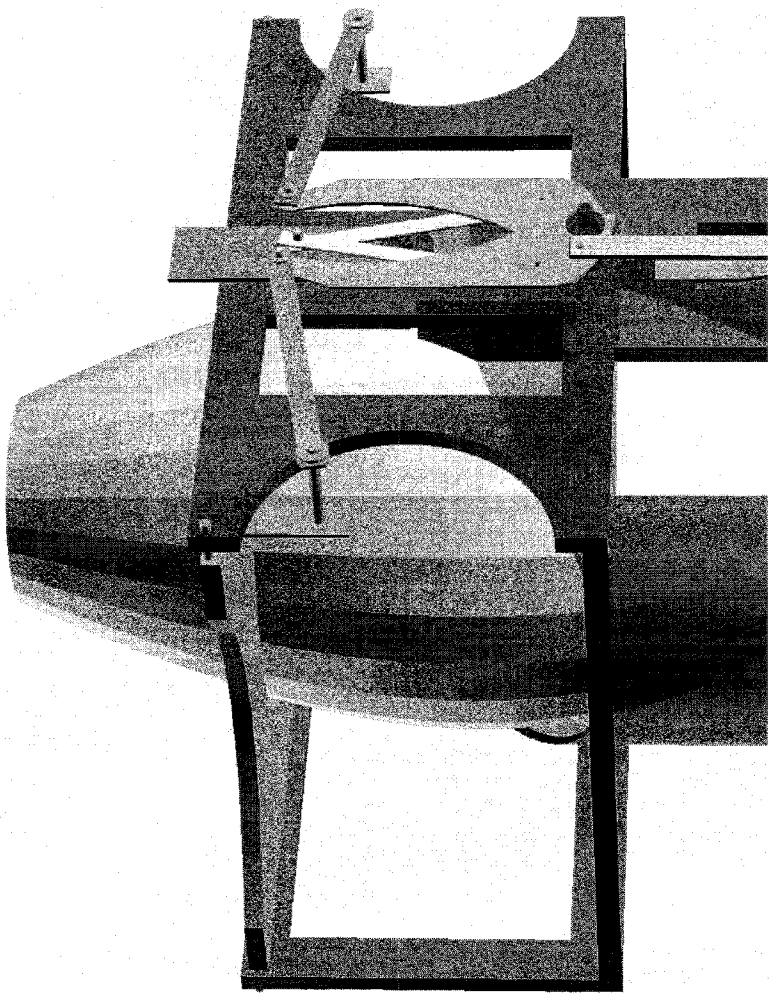
Figure 33:
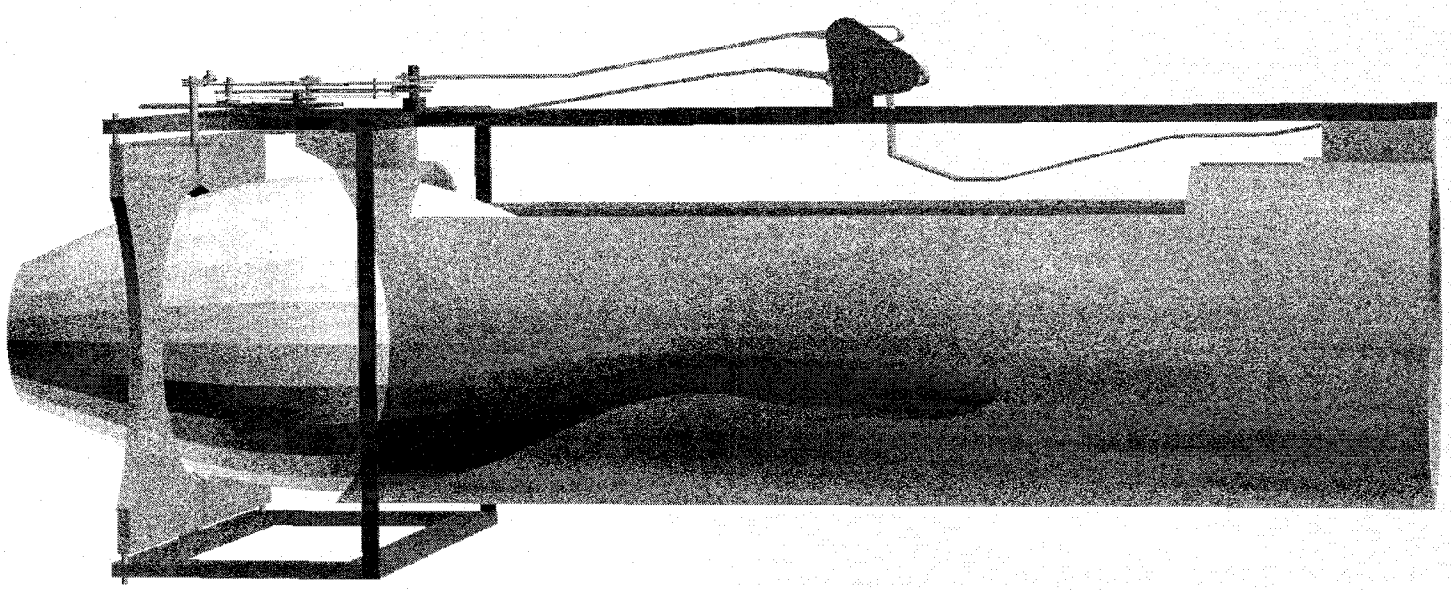
Figure 34:
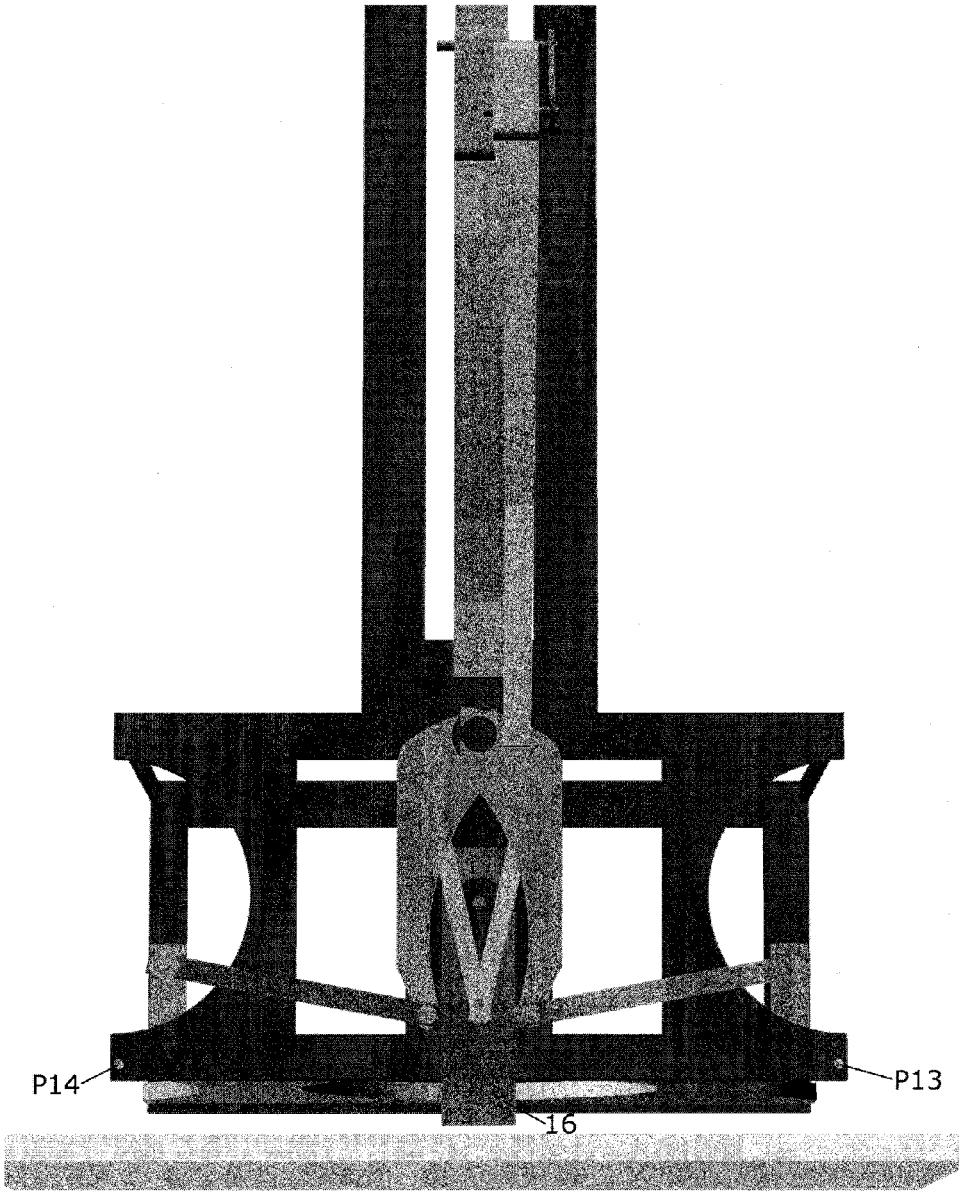
FIGS. 34-37 detail the mechanism at various stages of the release operation.
Figure 35:
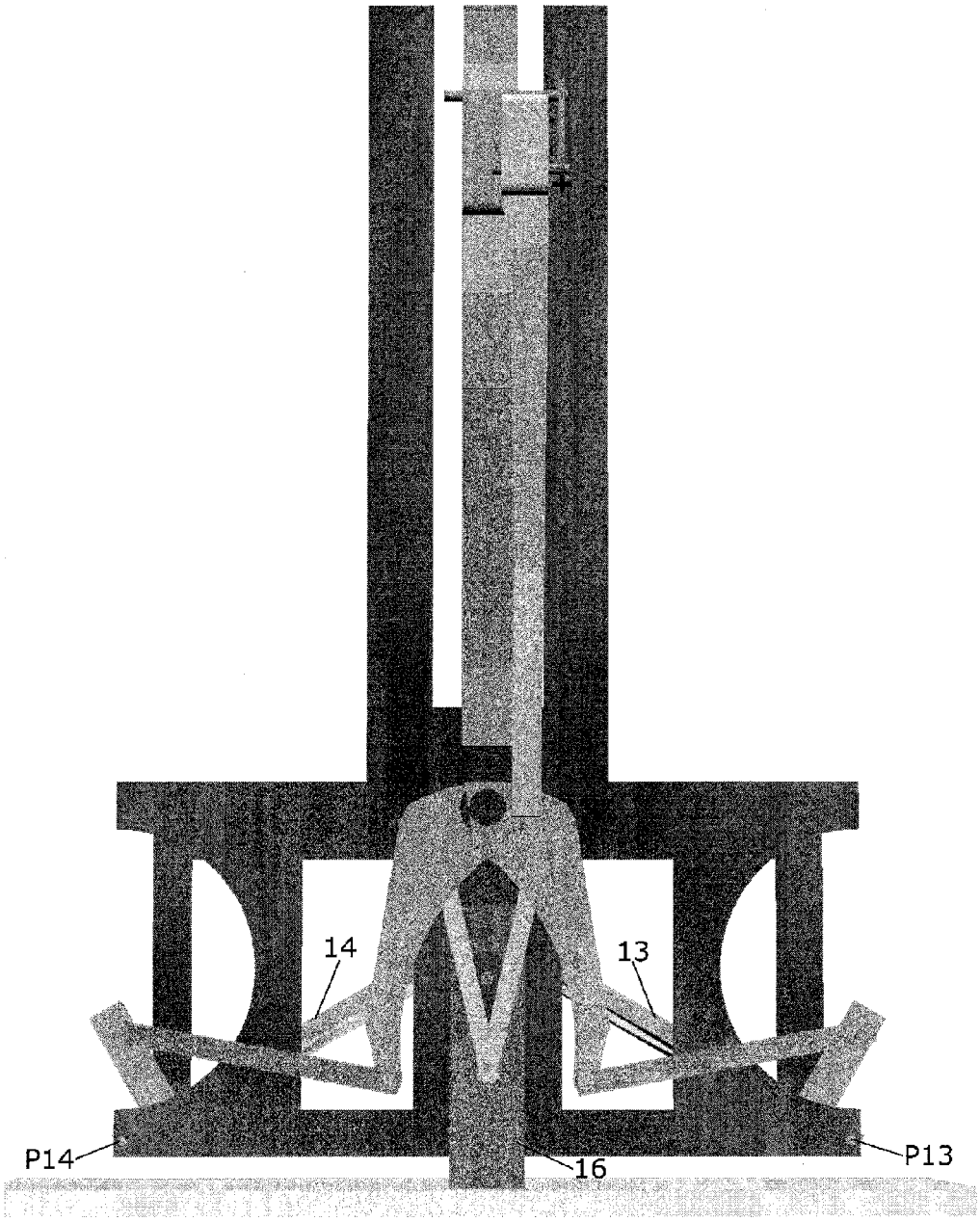
Figure 36:
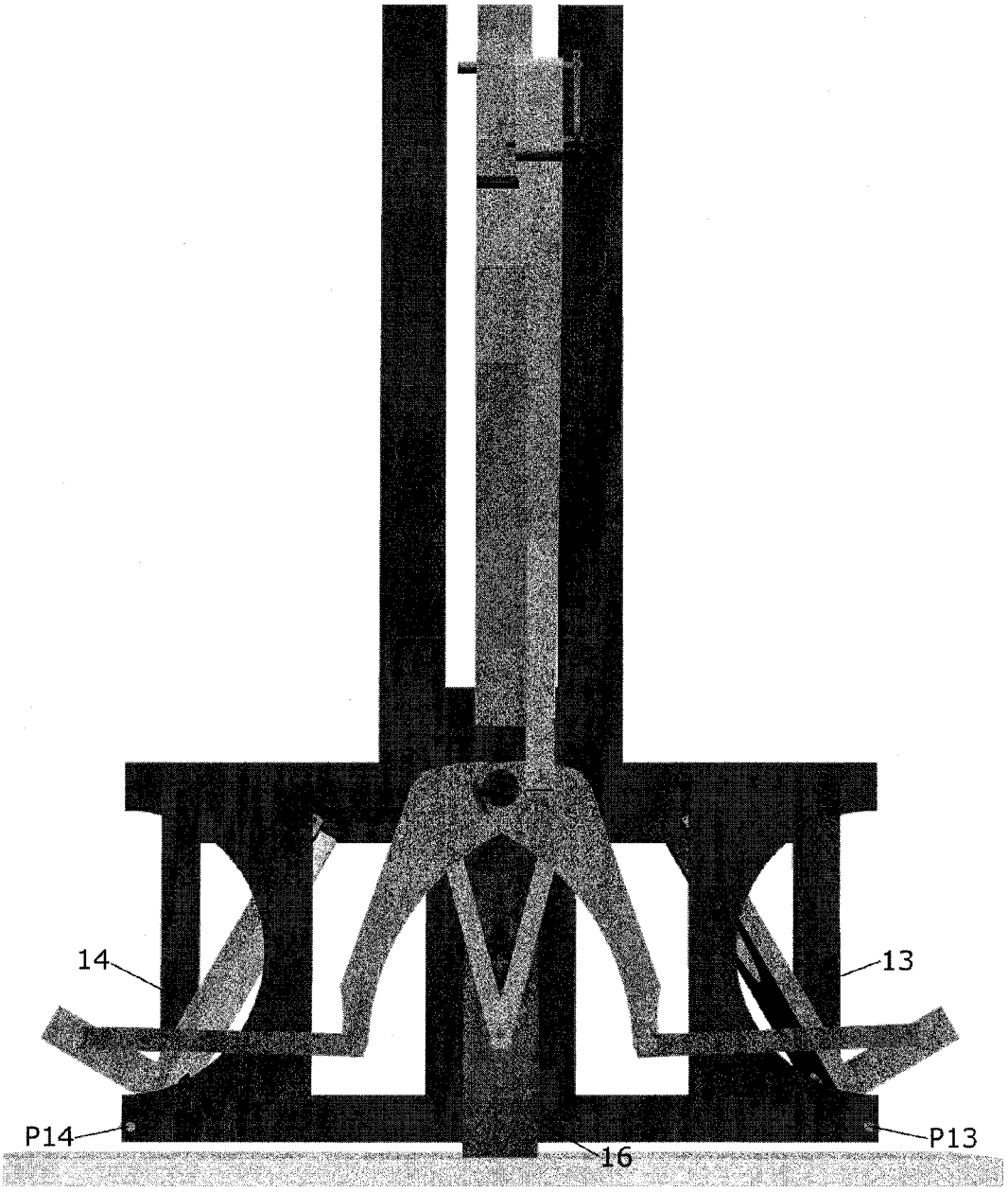
Figure 37:
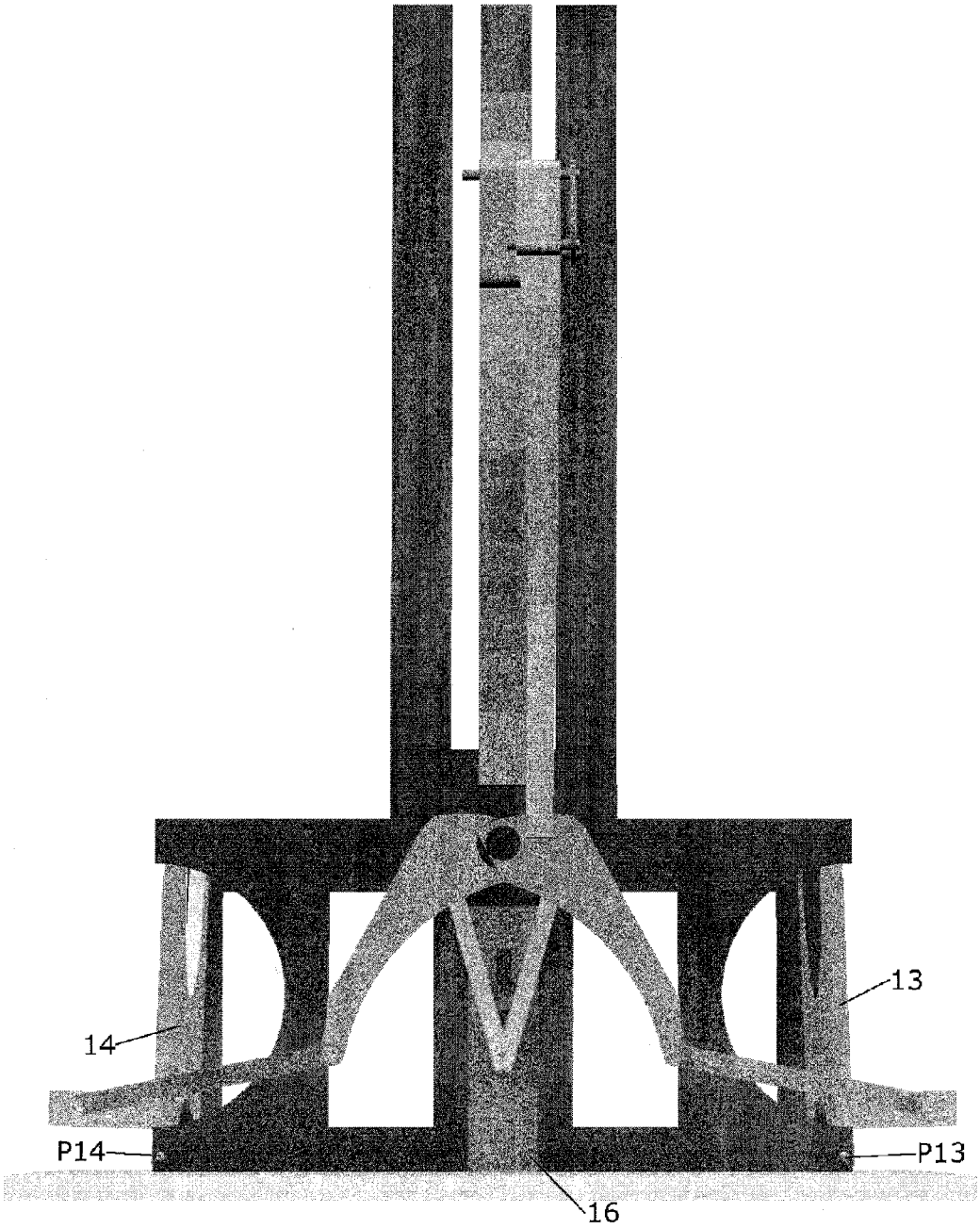
Figure 38:
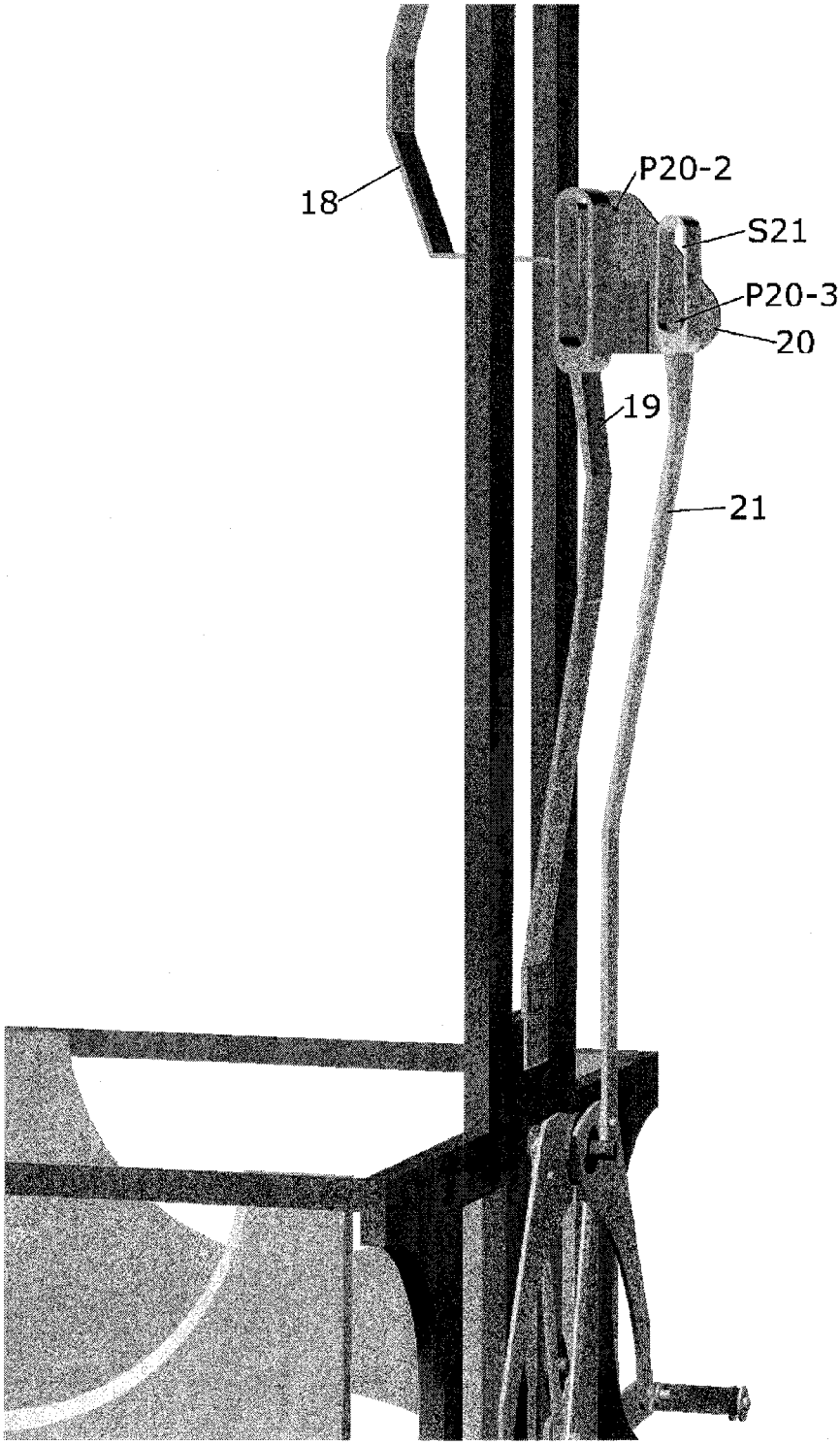
FIGS. 38-41 show the stages of reset actuator 21 on the down stroke as reset linkage 20 rotates.
Figure 39:
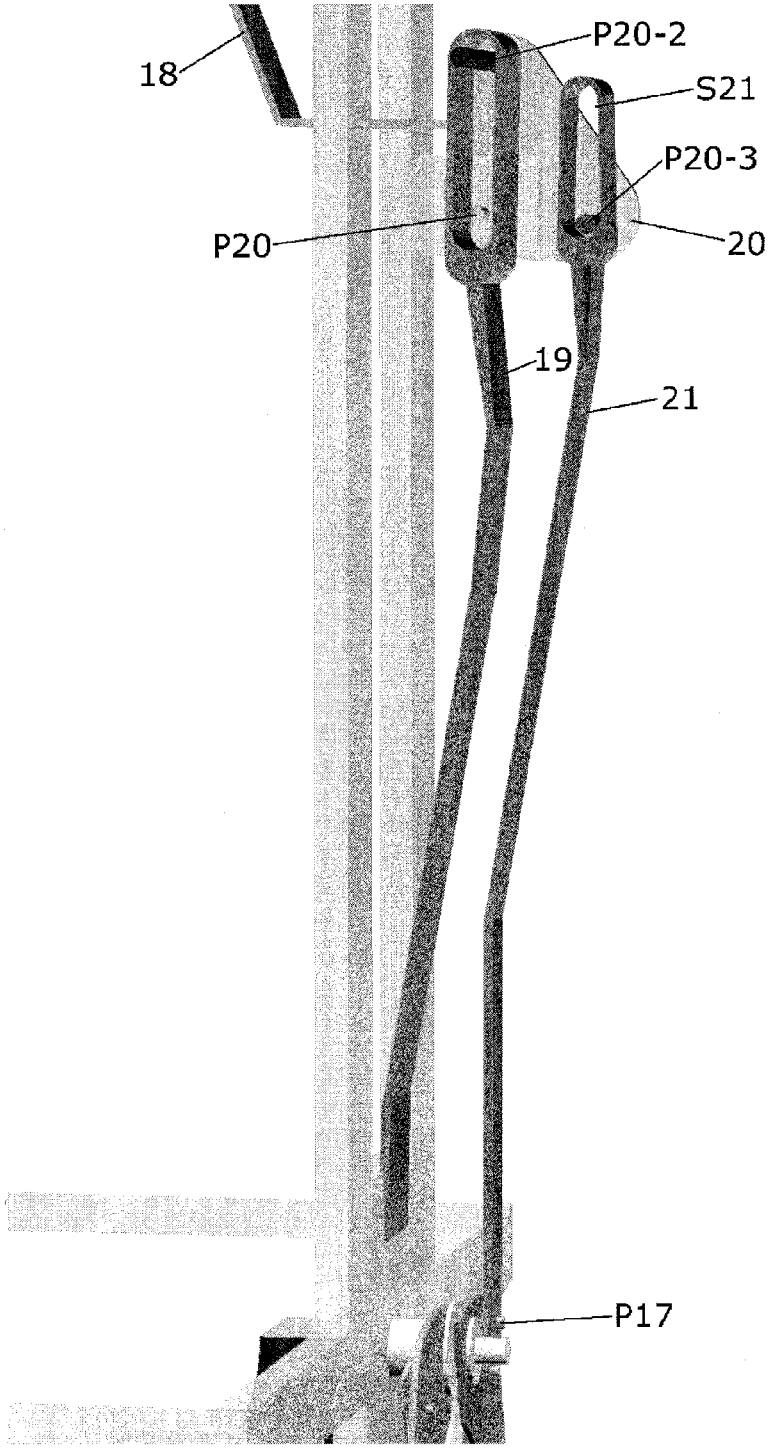
Figure 40:
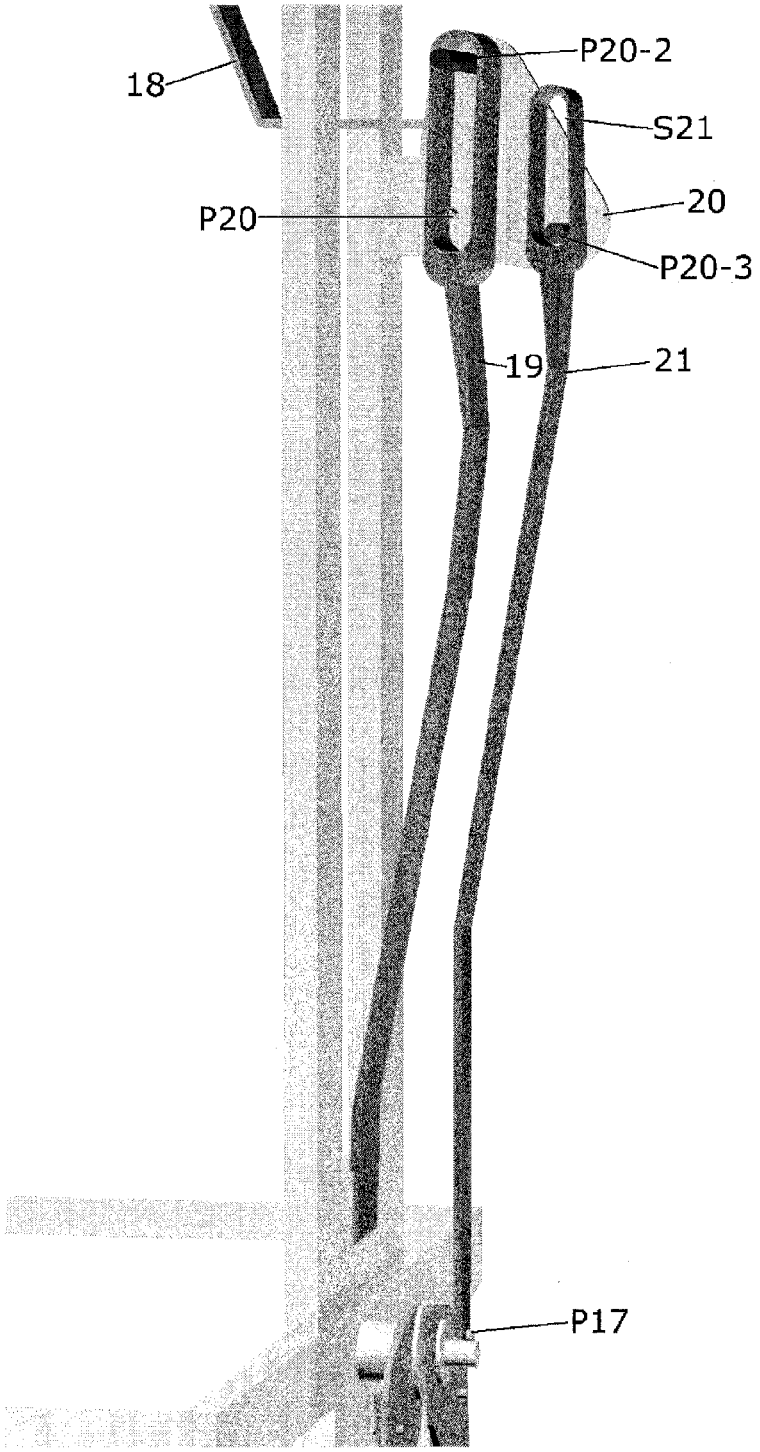
Figure 41:
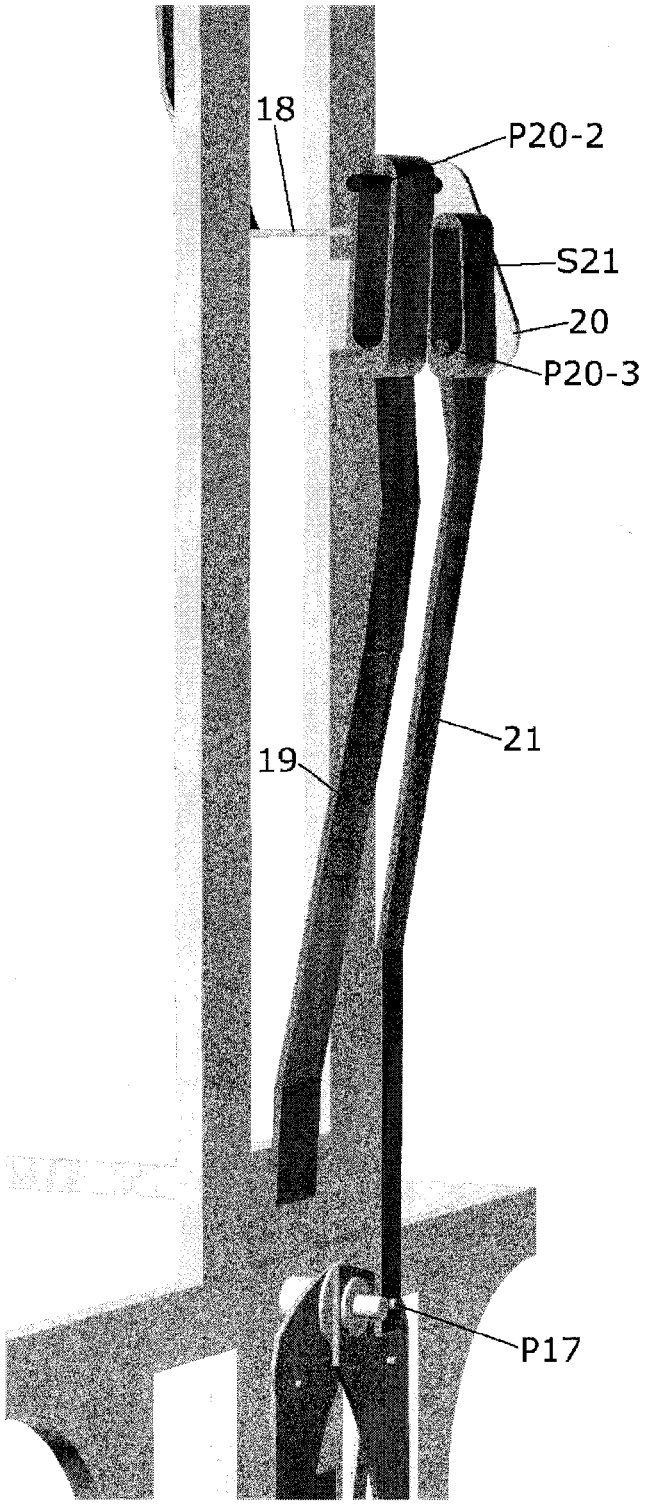

Bowling pin travel ceases when it comes into contact with pin supports 13 and 14. Fattest part of bowling pin is now beyond reset lever 18. Reset return spring 19 causes reset lever 18 to return to reset position in pin tube 12. In addition, reset return spring 19 causes reset linkage 20 to return to reset position, as shown in FIGS. 31-33. The bowling pin is now ready to be released.

Release Mechanism

First Embodiment

FIGS. 34-37 detail the mechanism at various stages of the release operation.

The release linkage assembly 17 employs a series of connected, pivoting levers that rotate pin supports 13 and 14 outward about pivot points P13 and P14 during the pin release operation. Reciprocating motion of release actuator 16 engages pivoting levers of release linkage assembly 17.

The advantage of this particular configuration is that with properly chosen geometry of the pivoting levers, when release actuator 16 is fully engaged, pin supports 13 and 14 are at maximum outward rotation and connecting levers of release linkage assembly 17 are fully extended.

In this way the mechanism is for all practical purposes locked and thus will prevent release supports 13 and 14 from inadvertently returning to support position and interfering with the bowling pin before the release operation has completed.

It will be understood, however, that this release configuration requires a number of components whose relationships are important to the release operation.

Reset Mechanism

First Embodiment

In this configuration, in order to reset the mechanism, that is, return pin supports 13 and 14 to pin support position, reset actuator 21 exerts downward force on release assembly 17 at pivot P17. Pivot location P17 is convenient because there is substantial leverage and very little movement is required to return pin supports 13 and 14 to pin support position. Thus, reset linkage assembly 20 does not need to rotate a great distance for reset actuator 21 to effectively move pivot P17. Notice too, that in this configuration, reset linkage 20 pivot P20 is below reset lever pivot P20-2, the location where reset lever 18 engages reset linkage 20.

When reset lever 18 moves, reset linkage 20 rotation is such that reset actuator 21 movement is downward.

FIGS. 38-41 illustrate reset actuator 21 on the down stroke as reset linkage 20 rotates. This motion causes pin supports 13 and 14 to return to pin support position.

Reset actuator 21 contains a slot S21 at the upper portion where it interacts with reset actuator pivot P20-3. When reset linkage 20 rotates, P20-3 contacts the bottom part of slot S21 thus causing reset actuator 21 to move downward. This downward movement causes P17 to close release linkage assembly 17, thus returning pin supports 13 and 14 to their pin release position.

Figure 42:
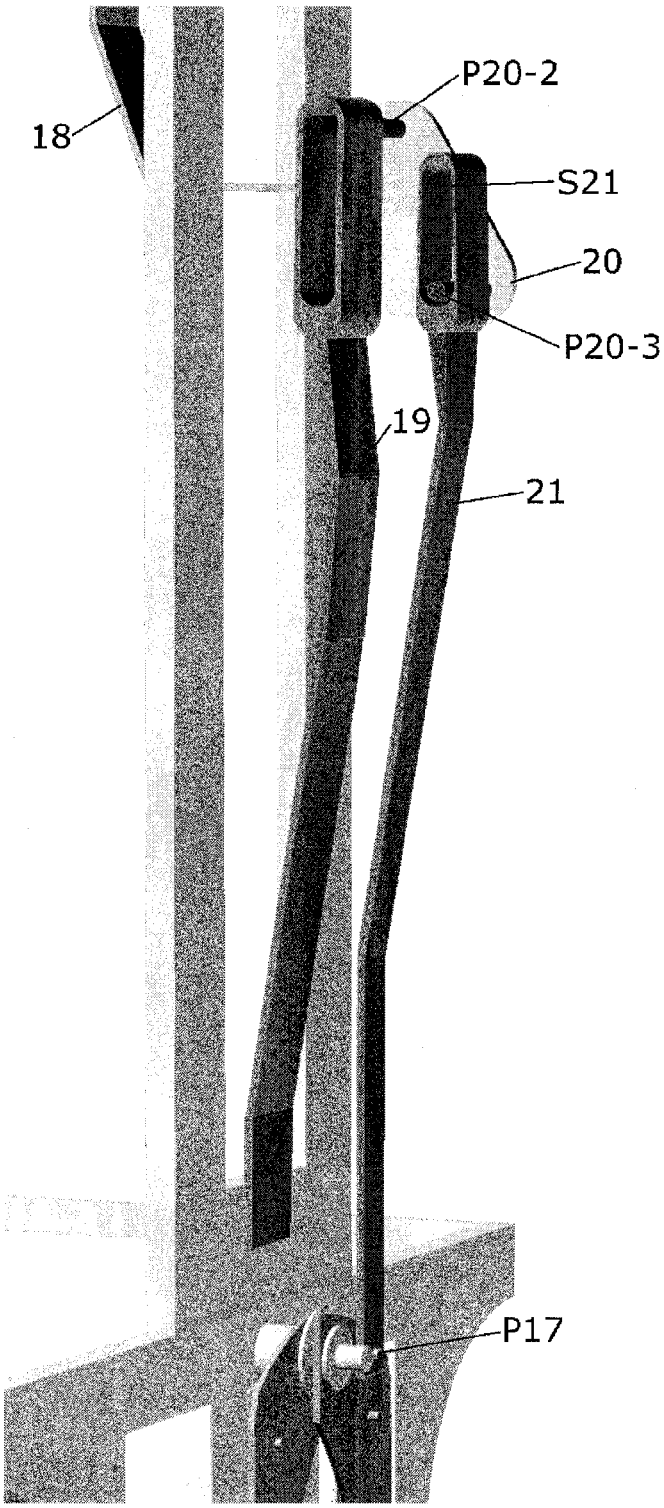
FIGS. 42-44 show reset actuator 21 returning to its initial state due to reset return spring 19 at location P20-2 of reset linkage 20.
Figure 43:
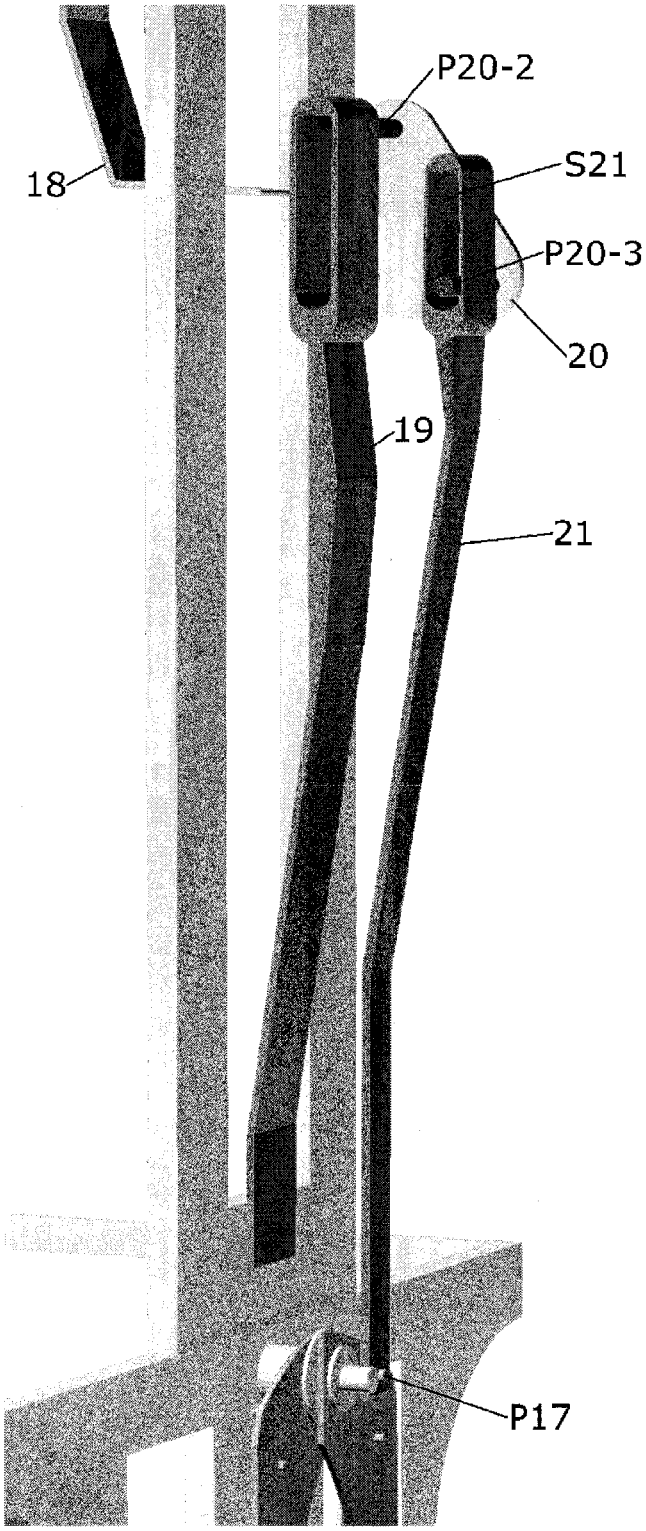
Figure 44:
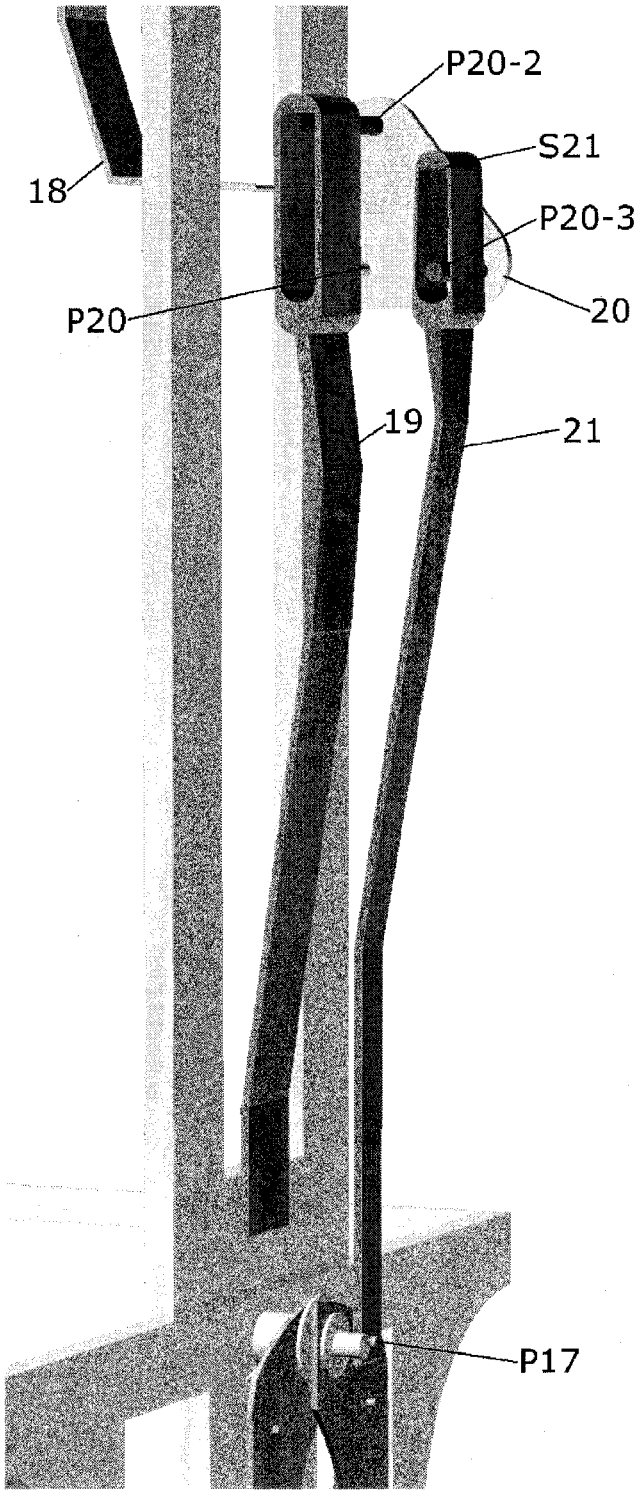
Figure 45:
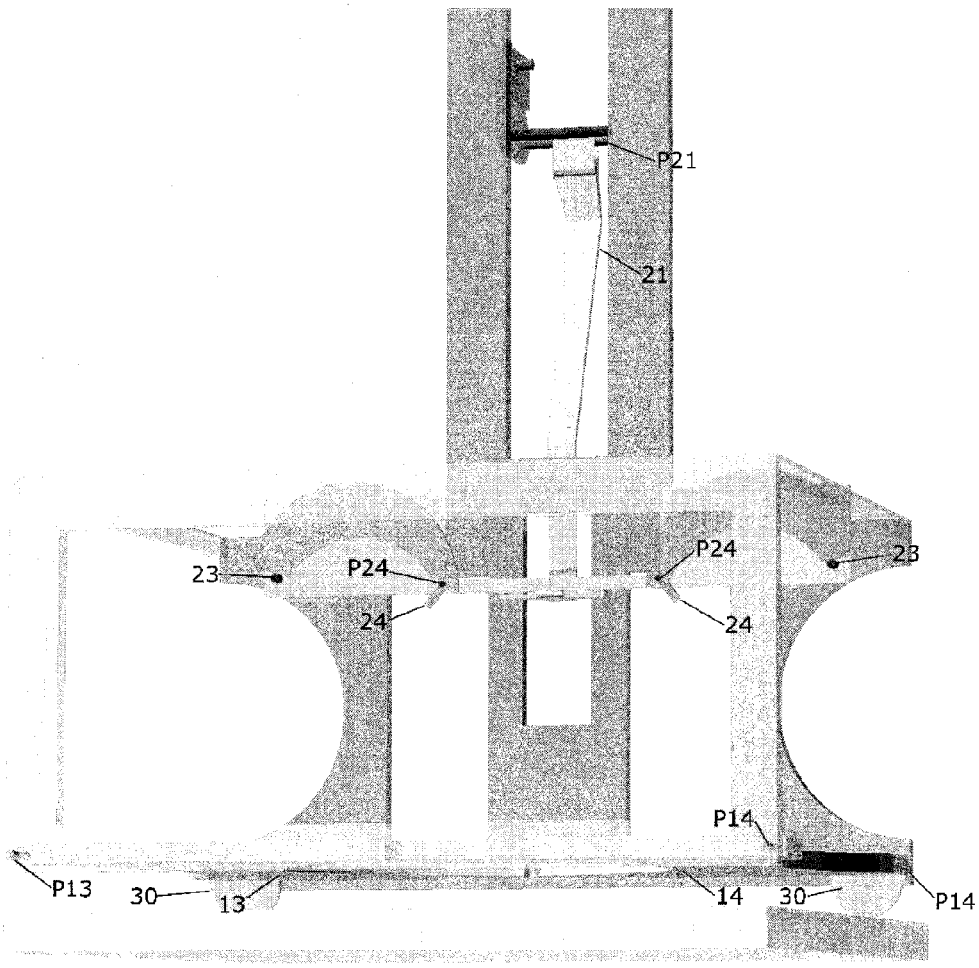
FIGS. 45-49 show the steps in the release operation of a second embodiment of the invention.
Figure 46:
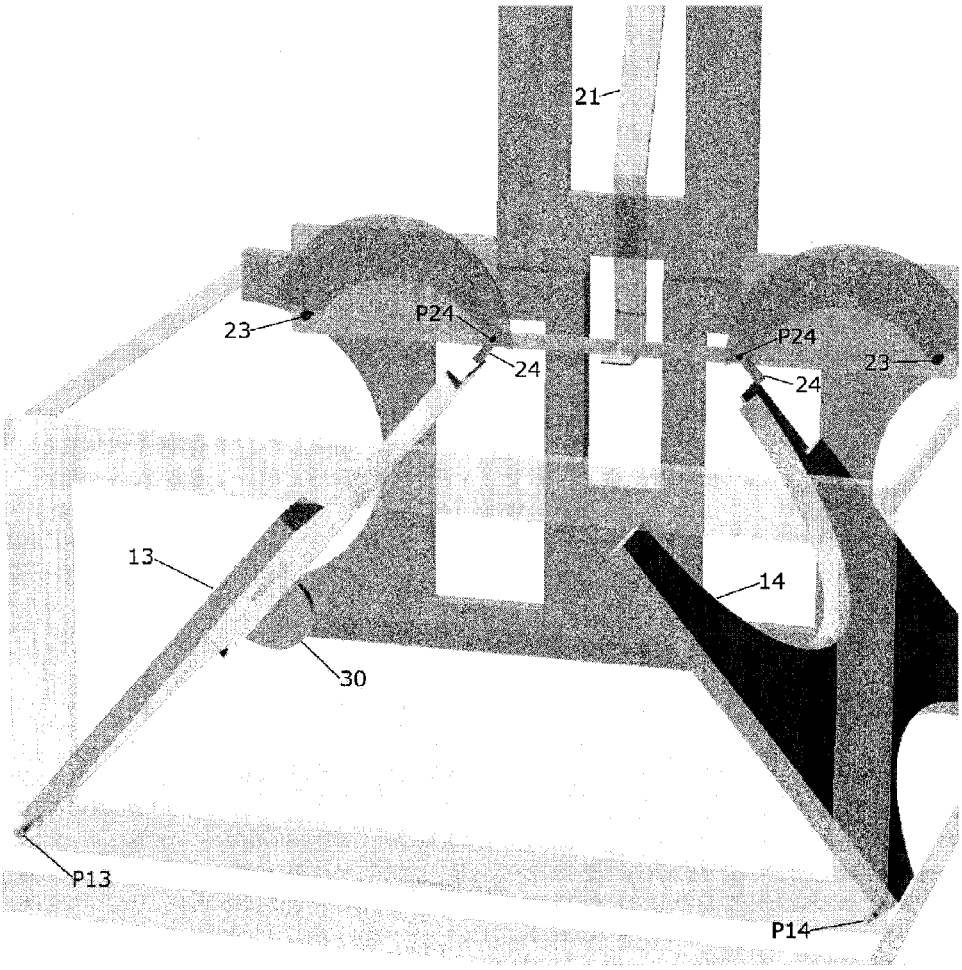
Figure 47:
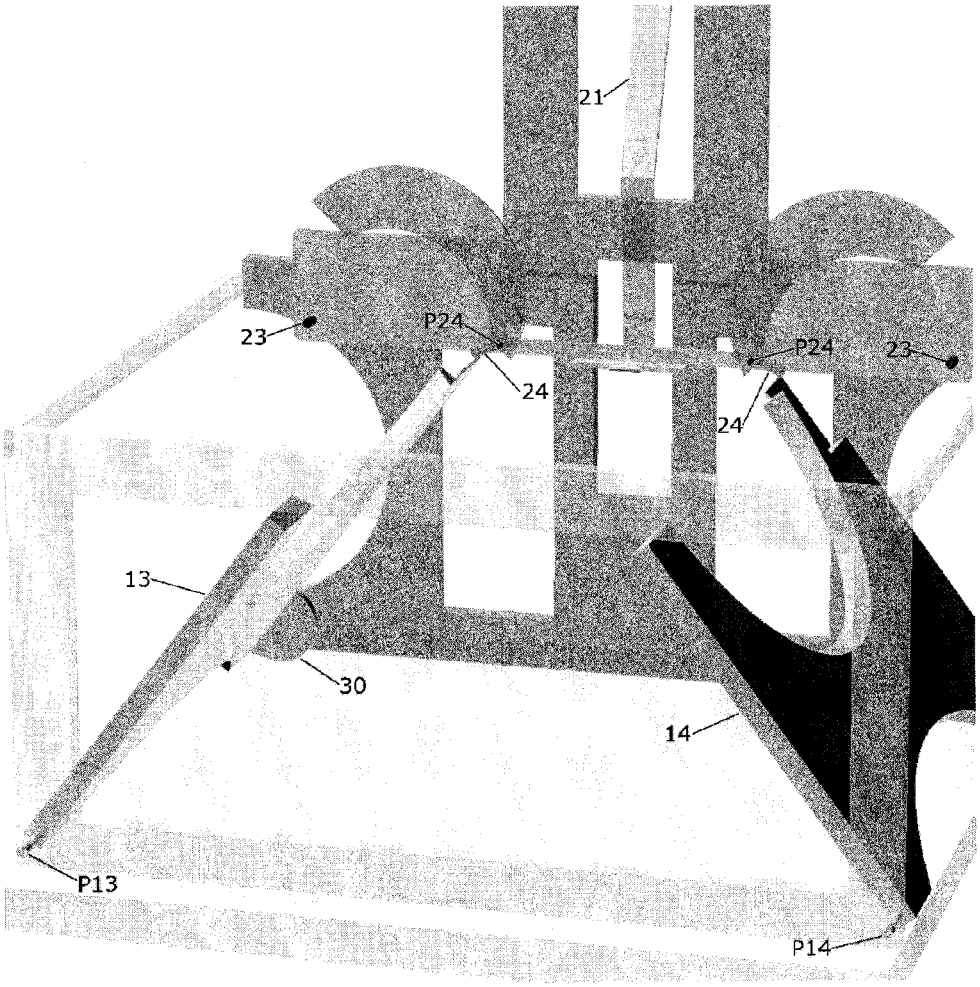
Figure 48:
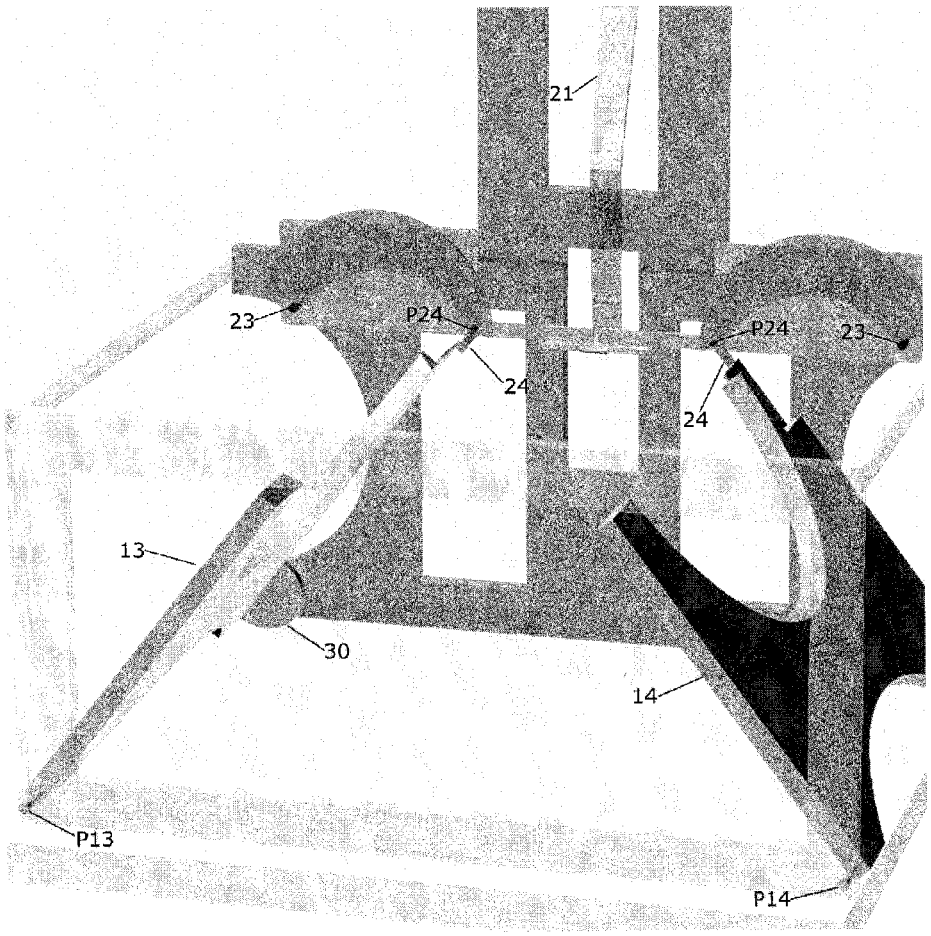

FIGS. 42-44 illustrate reset actuator 21 returning to its initial state due to reset return spring 19 at location P20-2 of reset linkage 20. Notice that reset actuator slot S21 allows pivot P20-3 to return when reset return spring rotates reset linkage at P20 without causing reset actuator 21 to move out of position. In this way slot S21 serves somewhat as a yoke mechanism.

Release/Reset Mechanisms

Second Embodiment

Referring to FIGS. 45-49, a second embodiment of the release mechanism eliminates release assembly 17 and release actuator 16 in favor of rounded release cams 30 on the underside of pin supports 13 and 14. These release cams 30 are near pivot locations P13 and P14 of pin supports 13 and 14.

FIGS. 45-48 illustrate the release operation in this embodiment. Release cams 30 cause pin supports 13 and 14 to rotate outward about pivot locations P13 and P14 when they come in contact with the bowling lane surface.

As the device lowers onto the lane surface, pin supports 13 and 14 rotate outward where they come into contact with pivoting latches 24. Pivoting latches 24 pivot about P24. Latches 24 are limited in their inward rotation by latch tabs 23.

As pin supports 13 and 14 continue outward rotation, they come into contact with latches 24 which rotate outward and upward.

There is sufficient clearance between pin supports 13 and 14 and latches 24 such that pin supports 13 and 14 rotate beyond latches 24. When that occurs, latches 24 freely rotate downward where they are stopped by latch tabs 23. Pin supports 13 and 14 are now held in place by latches 24.

Figure 49:
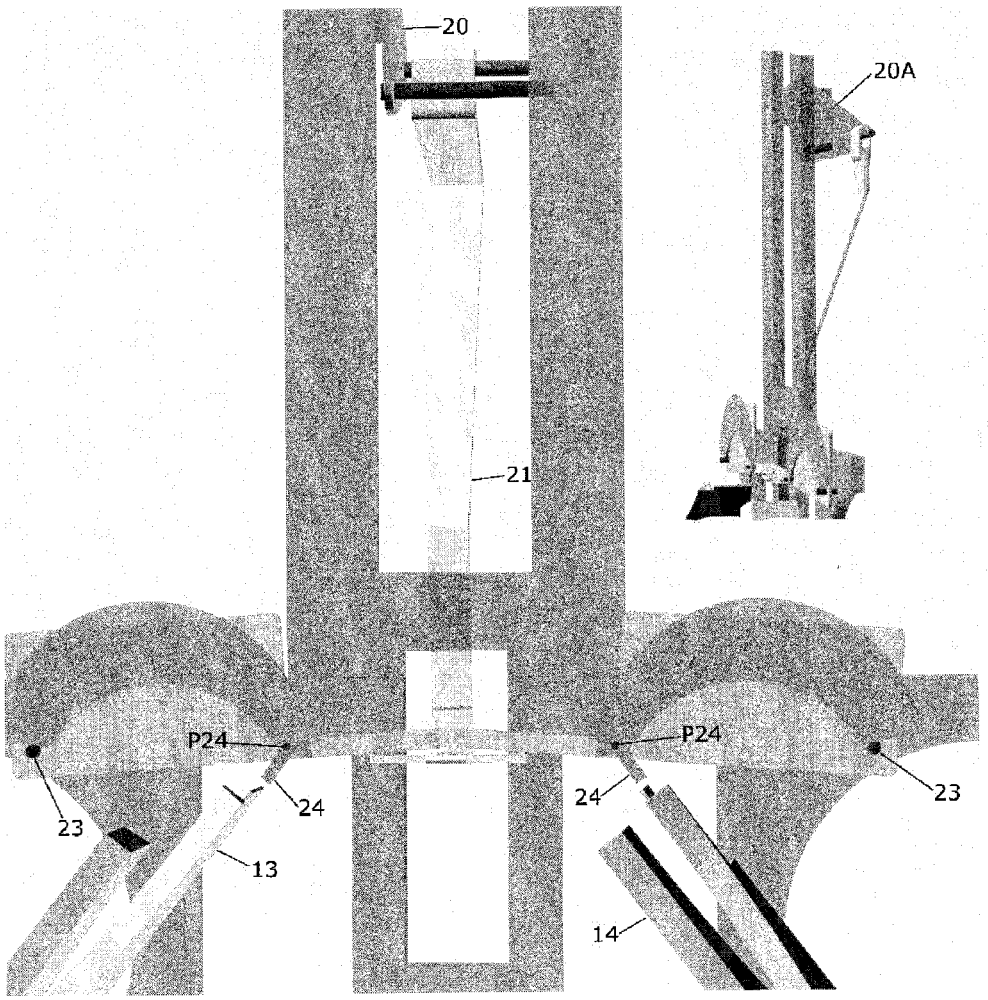

FIG. 49 shows the positioning of the components when reset linkage 20 is in upward rotation. To reset pin supports 13 and 14, the action of reset lever 18 is the same as the first embodiment, that is, movement of reset lever 18 causes reset linkage 20 to rotate.

However, in this embodiment, rotation of reset linkage 20 causes reset actuator 21 to move upwards rather than downwards. This causes latches 24 to move up away from pin supports 13 and 14.

Pin supports 13 and 14 are then able to freely rotate inward, no longer being supported by latches 24. Pin supports 13 and 14 rotate back to their pin support position.

At this point, the device is considered reset, ready for the pin to be released.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

TABLE OF REFERENCE NUMERALS

| | |
|---|---|
| 11 | bowling pin cell |
| 12 | bowling pin tube |
| 13 | bowling pin support |
| 14 | bowling pin support |
| 15 | support stop tab |
| 16 | release actuator |
| 17 | release linkage assembly |
| 18 | reset lever |
| 19 | reset return spring |
| 20 | reset linkage assembly |
| 20A | Side view of reset linkage assembly |
| 21 | reset actuator |
| 30 | release cam |
| B13 | beveled edge of pin support 13 semi-circular cutout SC13 |
| B14 | beveled edge of pin support 14 semi-circular cutout SC14 |
| H1 | circular hole formed by semi-circular cutouts SC13 and SC14 when pin supports 13 and 14 are in pin support position |
| P13 | bowling pin support 13 pivot |
| P14 | bowling pin support 14 pivot |
| P17 | release linkage assembly 17 reset pivot |
| P20 | reset linkage 20 pivot |
| P20-2 | reset lever 18 pivot |
| P20-3 | reset actuator 21 pivot |
| S21 | reset actuator 21 slot |
| SC13 | pin support 13 semi-circular cutout |
| SC14 | pin support 14 semi-circular cutout |

What is claimed is:

1. A self-contained, resettable release mechanism for a bowling pin having a top, a bottom, an upper portion and a lower portion, the lower portion of the bowling pin having a diameter tapering from a fattest portion downward to the bottom of the pin, the mechanism comprising:

a) a frame, vertically movable from an upper position to a lower position above a lane surface;

b) a first bowling pin support and a second bowling pin support for supporting a bowling pin, each bowling pin support being pivotally mounted to the frame on a pivot for pivotal motion from a pin support position wherein the bowling pin supports are horizontal and in contact with a stop tab, upward and outward to a release position in which the bowling pin supports are vertical;

each bowling pin support having an inside edge with an approximately semi-circular cutout, the cutouts being beveled to conform to the slope of the lower portion of the bowling pin;

each of the bowling pin supports having an inside edge, the inside edges facing each other when the bowling pin supports are in the pin support position, such that when the bowling pin supports are in the pin support position the cutouts form a generally circular hole having a diameter smaller than the diameter of the fattest portion of the lower portion of the bowling pin;

the pivots of the bowling pin supports being mounted sufficiently far apart such that when the bowling pin supports are in the release position, the bowling pin supports do not interfere with the released bowling pin;

c) a bowling pin tube mounted above the bowling pin supports and centered such that when the first bowling pin support and the second bowling pin support are in the support position, the lower portion of a bowling pin in the bowling pin tube is supported in the circular hole formed by the semicircular cutouts of the bowling pin supports with the bottom of the pin extending downwardly from the frame;

d) a first linkage assembly coupled at a first end to the first bowling pin support and a second linkage assembly coupled at a first end to the second bowling pin support, a second end of the first linkage assembly being coupled to a second end of the second link assembly by a release actuator extending below the frame;

the release actuator and linkage assemblies being arranged such that when the frame is lowered to a lane surface, the release actuator contacts the lane surface, and upward movement of the release actuator moves the second ends of the first linkage assembly and the second linkage assembly to pivot the first bowling pin support and the second bowling pin support from the support position to the release position, and when the frame has reached a lowest position the bowling pin supports are at maximum outward rotation in the release position and do not interfere with the bowling pin;

e) a reset lever having a first end inserted into a side of the bowling pin tube; and f) a reset linkage assembly coupled to the reset lever, the first linkage assembly and the second linkage assembly, such that when a bowling pin is inserted into the bowling pin tube, the fattest portion of the lower portion of the bowling pin contacts the first end of the reset lever, moving the reset lever to cause the first linkage assembly to move the first bowling pin support from the release position to the support position and the second linkage assembly to move the second bowling pin support from the release position to the support position, and the bowling pin slides downward through the bowling pin tube to be supported by the bowling pin supports.

2. A self-contained, resettable release mechanism for a bowling pin having a top, a bottom, an upper portion and a lower portion, the lower portion of the bowling pin having a diameter tapering from a fattest portion downward to the bottom of the pin, the mechanism comprising:

a) a frame, vertically movable from an upper position to a lower position above a lane surface;

b) a first bowling pin support and a second bowling pin support for supporting a bowling pin, each bowling pin support being pivotally mounted to the frame on a pivot for pivotal motion from a pin support position wherein the bowling pin supports are horizontal and in contact with a stop tab, upward and outward to a release position in which the bowling pin supports are vertical;

each bowling pin support having an inside edge with an approximately semi-circular cutout, the cutouts being beveled to conform to the slope of the lower portion of the bowling pin;

each of the bowling pin supports having an inside edge, the inside edges facing each other when the bowling pin supports are in the pin support position, such that when the bowling pin supports are in the pin support position the cutouts form a generally circular hole having a diameter smaller than the diameter of the fattest portion of the lower portion of the bowling pin;

each of the bowling pin supports having a cam mounted on the bowling pin support adjacent to the pivot, such that when the frame is lowered to the lower position, the cam contacts the lane surface and pivots the bowling pin support from the support position to the release position;

the pivots of the bowling pin supports being mounted sufficiently far apart such that when the bowling pin supports are in the release position, the bowling pin supports do not interfere with the released bowling pin;

c) a bowling pin tube mounted above the bowling pin supports and centered such that when the first bowling pin support and the second bowling pin support are in the support position, the lower portion of a bowling pin in the bowling pin tube is supported in the circular hole formed by the semicircular cutouts of the bowling pin supports with the bottom of the pin extending downwardly from the frame;

d) a first latch pivotally mounted to the frame above the first bowling pin support, such that as the first bowling pin support pivots to the release position, an end of the first bowling pin support contacts the first latch, rotating the first latch outward and upward, such that when the first bowling pin support fully moves to the release position, the end of the first bowling pin support has been moved past the first latch and the first bowling pin support is held in the released position by the first latch;

e) a second latch pivotally mounted to the frame above the second bowling pin support, such that as the second bowling pin support pivots to the release position, an end of the second bowling pin support contacts the second latch, rotating the second latch outward and upward, such that when the second bowling pin support fully moves to the release position, the end of the second bowling pin support has been moved past the second latch and the second bowling pin support is held in the released position by the second latch;

f) a reset lever having a first end inserted into a side of the bowling pin tube;

g) a reset linkage assembly coupled to the reset lever, the first latch and the second latch, such that when a bowling pin is inserted into the bowling pin tube, the fattest portion of the lower portion of the bowling pin contacts the first end of the reset lever, moving the reset lever to move the first latch and the second latch, allowing the first bowling pin support and the second bowling pin support to move from the release position to the support position, and the bowling pin slides downward through the bowling pin tube to be supported by the bowling pin supports.

* * * * *